US011652281B1

(12) United States Patent
Birnbach

(10) Patent No.: US 11,652,281 B1
(45) Date of Patent: May 16, 2023

(54) COMPACT COVERT FRACTAL ANTENNAE

(71) Applicant: Advanced Fusion Systems LLC, Newtown, CT (US)

(72) Inventor: Curtis Birnbach, New Rochelle, NY (US)

(73) Assignee: ADVANCED FUSION SYSTEMS LLC, Newtown, CT (US)

( * ) Notice: Subject to any disclaimer, the term of this patent is extended or adjusted under 35 U.S.C. 154(b) by 0 days.

(21) Appl. No.: 17/719,954

(22) Filed: Apr. 13, 2022

(51) Int. Cl.

| | |
|---|---|
| ***H01Q 1/36*** | (2006.01) |
| ***H01Q 1/38*** | (2006.01) |
| ***H01Q 3/34*** | (2006.01) |
| ***H01Q 3/36*** | (2006.01) |
| ***F42C 13/04*** | (2006.01) |
| ***H01Q 1/08*** | (2006.01) |

(52) U.S. Cl.
CPC ..... *H01Q 1/36* (2013.01); *F42C 13/04* (2013.01); *H01Q 1/08* (2013.01); *H01Q 1/38* (2013.01); *H01Q 3/34* (2013.01); *H01Q 3/36* (2013.01)

(58) Field of Classification Search
CPC .. H01Q 1/36; H01Q 1/08; H01Q 3/36; H01Q 1/38; H01Q 3/34; F42C 13/04
USPC ..... 102/206
See application file for complete search history.

(56) References Cited

U.S. PATENT DOCUMENTS

| | | | | |
|---|---|---|---|---|
| 7,088,965 | B1 * | 8/2006 | Ngan | H01Q 21/29 455/67.11 |
| 8,009,111 | B2 * | 8/2011 | Baliarda | H01Q 9/28 343/702 |
| 8,059,050 | B1 * | 11/2011 | Johnson | H01Q 5/25 343/773 |
| 11,005,188 | B2 | 5/2021 | Cohen et al. | |
| 2003/0151556 | A1 * | 8/2003 | Cohen | H01Q 5/371 343/702 |
| 2008/0129622 | A1 * | 6/2008 | Freeland | G01V 15/00 343/719 |
| 2014/0097986 | A1 * | 4/2014 | Xue | H01Q 3/34 342/372 |

* cited by examiner

*Primary Examiner* — Hai V Tran
(74) *Attorney, Agent, or Firm* — Leason Ellis LLP

(57) ABSTRACT

The present disclosure describes a fractal antenna comprising a plurality of antenna elements having a two-dimensional fractal shape and an electrical circuit coupled to the plurality of antenna elements operative to provide electrical power to and maintain phase relationships between the plurality of antenna elements. The electrical circuit provides a signal to the plurality of antenna elements that cause the antenna elements to radiate in the high-frequency (HF) and/or low-frequency (LF) bands. Also described is an antenna comprising a three-dimensional fractal, near-fractal, or super-fractal antenna having a fractal, near-fractal or super-fractal shape.

31 Claims, 20 Drawing Sheets

COMPACT COVERT FRACTAL ANTENNAE

FIELD OF THE INVENTION

The present disclosure relates to the design and manufacture of a class of electromagnetic antennae based on fractal geometry and in particular the design and implementation of antennae for covert communications applications for high reliability communications networks. The present disclosure introduces the concepts of near-fractal and super-fractal geometries.

DEFINITIONS

Antenna: An antenna is a bidirectional device used to transform an RF signal, traveling on a conductor, into an electromagnetic wave in free space or transform an electromagnetic wave travelling in free space into an electrical signal. While most antennae are commonly made from conductive materials, antennae can also be made from dielectrics.

Beamforming: Beamforming is the application of multiple radiating elements transmitting the same signal at an identical wavelength and phase, which combine to create a single antenna with a longer, more targeted stream which is formed by reinforcing the waves in a specific direction. If the relative phases are varied, and the angle of radiation varies. (See also "Phased Array").

Beam steering: Beam steering is achieved by changing the phase of the input signal on all radiating elements. Phase shifting allows the signal to be targeted at a specific receiver. An antenna can employ radiating elements with a common frequency to steer a single beam in a specific direction. Different frequency beams can also be steered in different directions to serve different users. The direction in which a signal is sent can be calculated dynamically by the base station as the endpoint moves, effectively tracking the user. (See also "Phased Array")

Effective Antenna Length: The effective length of a linearly polarized antenna receiving a plane wave in a given direction is defined as "the ratio of the magnitude of the open-circuit voltage developed at the terminals of the antenna to the magnitude of the electric-field strength in the direction of the antenna polarization". Height can be construed as being equivalent to length in this document.

Element (Antenna Element): In this document, the term "element" is used to describe a major section of an antenna, typically where a structure of the antenna is repeated in some form or scale.

EMP: Abbreviation for ElectraMagnetic Pulse. A phenomenon that occurs typically when there is an atomic explosion in which a large extremely broadband radio pulse is emitted as a result of ionization due to the explosion interacting with particles in the atmosphere or surrounding region of the blast. It is noted that large chemical explosions can give rise to EMP as well as nuclear events. The interactions of EMP with electronics can be very destructive and as such, precautions are taken to protect critical infrastructure equipment from the effects of EMP.

Fractal: A geometric pattern based on mathematics first clearly espoused by Benoit Mandelbrot in his work, "The fractal geometry of nature." *Mandelbrot, Benoît B.* (1983). (Macmillan. ISBN 978-0-7167-1186-5). Fractals have been described as: "A rough or fragmented geometric shape that can be split into parts, each of which is (approximately) a reduced-size copy of the whole".

Fratricidal: In this context, the term "Fratricidal" is a military term and refers to inflicting damage on oneself or friendly forces and equipment.

Frequency Band Descriptions: For the purposes of this document the following definitions apply:

a. LF: Low Frequency. Frequencies less than 1 MHz. Includes VLF (Very Low Frequency) and ULF (Ultra Low Frequency)
b. HF: High Frequency: Frequencies between 1 MHz and 30 MHz
c. VHF: Very High Frequency: Frequencies between 30 MHz and 500 MHz
d. Microwave: Frequencies above 500 MHz Gain: A multiplication factor applied to antenna performance which describes the amplification factor that a specific design affords, frequently concerning propagation in a specific direction relative to the main axis of the antenna.

Groundwave: Groundwave refers to the propagation of radio waves parallel to and adjacent to the surface of the Earth, following the curvature of the Earth.

Koch Curve, Koch Snowflake: Interchangeable names of a particular fractal geometric structure or portion of said structure that in its higher orders resembles a snowflake. Based on an equilateral triangle, each successive stage is formed by adding outward bends to each side of the previous stage, making smaller equilateral triangles. The areas enclosed by the successive stages in the construction of the snowflake converge to $\frac{8}{5}$ times the area of the original triangle, while the perimeters of the successive stages increase without bound. Consequently, the snowflake encloses a finite area, but has a theoretically infinite perimeter. It is noted that other triangles may be used and will yield similar but discreetly different resulting fractal patterns. In this document, the term "snowflake" is used in both the specific and generalized sense.

Near-Fractal: A novel antenna geometry, generally in the class of three-dimensional fractal antennae, where a fractal is used to describe the surface topology but the spacing between repeats of the fractal curve pattern is constant as opposed to a true fractal design where the spacing between repeats of the pattern changes by a constant fraction. The term can also be applied to any other fractal-like structure where one or more variables are either held constant or varied in opposition to the classic rules of fractal geometry.

Phased Array: A phased array is a class of antennae comprised of a group of sensors located at distinct spatial locations in which the relative phases of the sensor signals are varied in such a way that the effective propagation pattern of the array is reinforced in a desired direction and suppressed in undesired directions. (See Beamforming; Beam steering).

Platform: In military parlance, any vehicle, vessel, aircraft, spacecraft, or other location where equipment may be installed.

Skywave: Skywave refers to the propagation of radio waves reflected or refracted back toward Earth from various layers in the ionosphere, the electrically charged layers of the upper atmosphere, as opposed to Groundwave, where waves travel over the surface of the Earth. Since it is not limited by the curvature of the Earth, skywave propagation can be used to communicate beyond the horizon, at intercontinental distances. It is mostly used in the shortwave frequency bands.

Super-Fractal: A novel antenna geometry, generally in the class of three-dimensional fractal antennae, where a fractal is used to describe the surface topology but the spacing between repeats of the fractal curve pattern varies from repeat to repeat, not necessarily repeating, thus adding a non-linearity to the overall geometric complexity of the shape.

BACKGROUND

In many communications applications, it is desirable to conceal the location of the antenna. This is particularly difficult at lower frequencies (as opposed to microwaves) where antennae tend to be physically large and difficult to conceal. As antennae are generally dimensioned in terms of wavelengths or fractions of a wavelength, as the frequency gets lower, the antenna gets bigger. The closer the length of antenna is to a full wavelength or to an integer multiple of a full wavelength of a desired signal, the better it will work. That said, a large percentage of antennae are built according to fractional wavelength dimensions, i.e. ½ wave, ¼ wave etc. The performance of these antennae is always less than those which are a full wavelength or integer wavelengths in length.

Fractal geometry as is currently known is generally credited to Benoit Mandelbrot. His work represents the culmination and synthesis of work that began in the 1870's and was further developed by the Swedish mathematician Helge von Koch who published an important paper in 1904. While he did not realize it at the time, this work described what we know as a primitive form of a fractal. A useful example of Koch's work is the Koch Curve, also known as the Koch Snowflake. It is based on an equilateral triangle, each successive stage is formed by adding outward bends to each side of the previous stage, making smaller equilateral triangles. FIG. 1 shows the first four iterations of the Koch Snowflake 100. The areas enclosed by the successive stages in the construction of the snowflake converge to ⅘ times the area of the original triangle 102, 103, 104, while the perimeters of the successive stages increase without bound. Consequently, the snowflake encloses a finite area, but has an infinite perimeter. In practice, it is noted that it is not necessary (or possible) to carry out sufficient iterations to achieve an infinite perimeter. It is further noted that the convergence does not necessarily have to be ⅘, but can be any fraction. When designing and constructing an antenna, one only need to iterate as far as is necessary to achieve the desired effective length of the antenna element designed based on a Koch snowflake. Looking at the definition of a fractal, a "fragmented geometric shape that can be split into parts, each of which is (approximately) a reduced-size copy of the whole", one can see that the length of the edge of a fractal is much greater than the overall length of the object.

Fractal antennae have been previously used, but their application has been limited to higher frequency (microwave) bands in applications such as cellular phones, handheld walkie-talkies, pagers, etc. An example of this is found in U.S. Pat. No. 11,005,188 by Cohen et al; May 11, 2021, entitled "Enhanced Antenna System".

However, to date, fractal antennae have not been used for low frequency applications. There remains a long felt need in the art to make use of the benefits of fractal geometry in low frequency transmission domain.

SUMMARY OF THE DISCLOSURE

In a first aspect, the present disclosure provides a fractal antenna that comprises one or more antenna elements having a two-dimensional fractal shape, and an electrical circuit coupled to the one or more antenna elements operative to provide electrical power to the one or more antenna elements. The electrical circuit provides a signal to the one or more antenna elements that causes the one or more antenna elements to radiate in the high-frequency (HF) and low-frequency (LF) bands.

More specifically, the present disclosure provides a fractal antenna that comprises a plurality of antenna elements having a two-dimensional fractal shape and an electrical circuit coupled to the plurality of antenna elements operative to provide electrical power to and maintain phase relationships between the plurality of antenna elements. The electrical circuit provides a signal to the plurality of antenna elements that cause the plurality of antenna elements to generate radiate in the high-frequency (HF) and/or low-frequency (LF) bands.

In another aspect, the present disclosure provides an antenna that comprises a three-dimensional fractal, near-fractal, or super-fractal antennae elements having a fractal, near-fractal or super-fractal shape.

In another aspect, the present disclosure provides a method of producing an antenna that comprises producing a three-dimensional antenna having a fractal, near-fractal, or super-fractal geometric profile using an additive manufacturing method.

In a further aspect, the present disclosure provides a system for detecting an underground structure. The system includes a vehicle or other platform upon which one or more fractal, near-fractal or super-fractal antenna elements are installed and an electrical circuit coupled to the one or more antenna elements operative to provide electrical power and control the one or more antenna elements. The one or more antenna elements are configured to transmit and detect LF signals emitted from underground structures.

In another aspect, the present disclosure provides a system for activating an explosive device remotely for defensive purposes. The system comprises a vehicle or other platform upon which one or more fractal, near-fractal or super-fractal antenna elements are installed and a LF RF transmitting means coupled to the one or more antenna elements operative to provide sufficient LF RF power and control the one or more antenna elements. The one or more antenna elements are configured to cause the one or more antenna elements to radiate in a directed beam in the LF band toward an explosive device, the beam of radiation operative to induce currents in the explosive device that causes both induction of electrical signal of sufficient intensity to activate electrical detonation means, and Ohmic heating that leads to an explosion of the device.

In yet another aspect, the present disclosure provides a fractal antenna weapon system comprising: a vehicle or other platform upon which one or more fractal, near-fractal or super-fractal antenna elements are installed and an electrical circuit coupled to the one or more antenna elements operative to provide transmitted RF power and control the one or more antenna elements. The one or more antenna elements are configured to cause the one or more antenna elements to radiate in a directed beam in the LF or other RF bands toward a structure having one or more electrical or electronic components, the beam of radiation operative to induce currents in the one or more electrical or electronic components to disable, destroy, or confuse the one or more components.

DETAILED DESCRIPTION

Figure 2A:
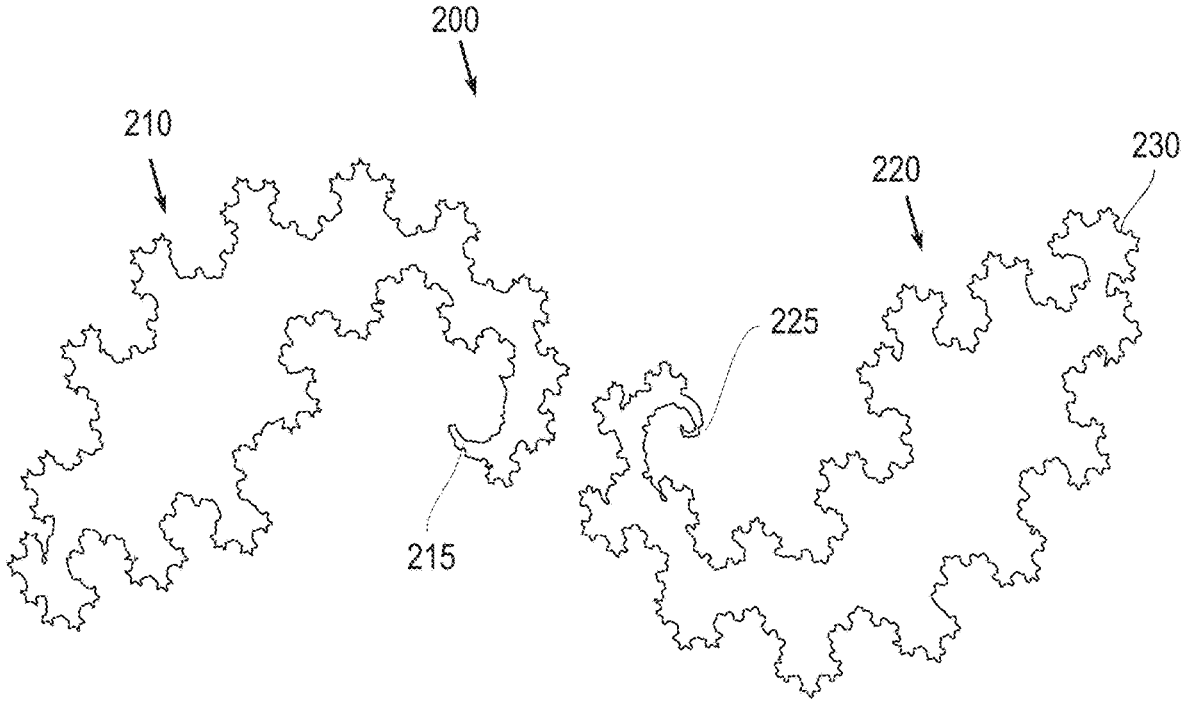
FIG. 2A shows a spiral fractal antenna for low frequency transmission and reception according to an embodiment of the present disclosure.
Figure 2B:
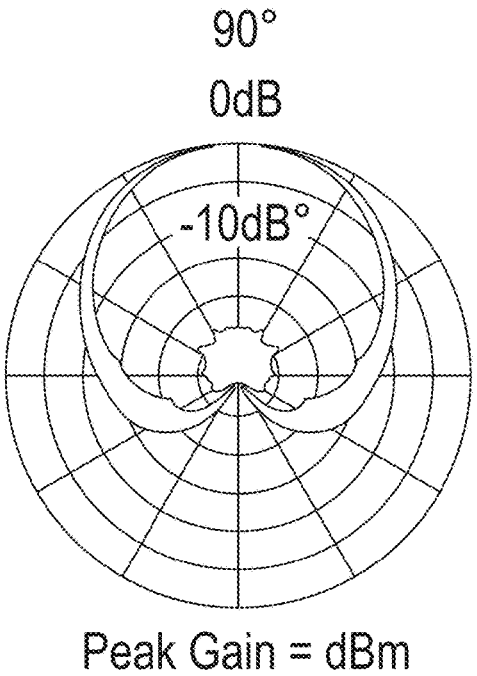
FIG. 2B shows a polar radiation plot of the spiral fractal antenna of FIG. 2A.

Fractal geometry is advantageously used for antenna design because such designs provide a longer effective length of the antennae in a given physical space. The more convoluted the fractal, the longer the effective length of the antenna. This advantage can be captured by integrating various antenna topologies with fractals to achieve longer effective length in a given physical space. FIG. 2A shows an example spiral fractal antenna 200 with two elements 210, 220 that can be used in the antenna designs according to the present disclosure. The addition of the Koch Curve 230 (also shown separately FIG. 4) as the fractal component allows the antenna to be operated at a substantially lower frequency as a result of the effective length being many times what it would be if the fractal edges were not included. The amount of increase in effective length is limited only by the ability of the manufacturing process used to make the antenna. This antenna is fed by two feedpoints at the center of the array 215, 225. A polar radiation plot 210 of the spiral fractal antenna of FIG. 2A is shown in FIG. 2B. As shown, there is appreciable gain within a 120° span with a maximum of 6 dB at 90° (212) indicating strong beam formation.

Figure 3:
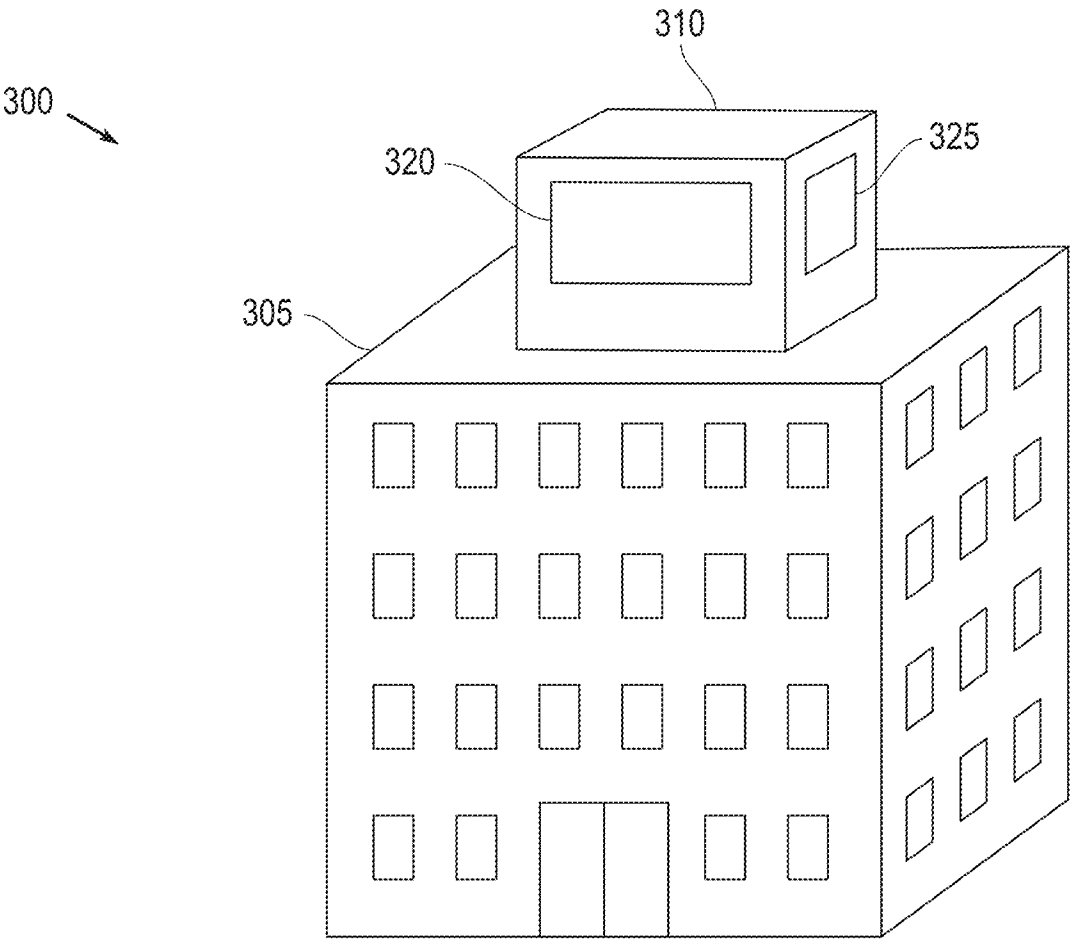
FIG. 3 shows an exemplary building in which flat fractal antenna arrays according to the present disclosure are installed.

To address the need for covert HF communication capabilities, the present disclosure comprises a building-integrated, electronically-steerable, flat panel antenna array. FIG. 3 is a schematic perspective view of a building 300 having a lower main section 305 and an elevator tower or water tower 310 upon which fractal low-frequency flat panel antennae are installed (of which two panels 315, 320 are shown in FIG. 3). Each array of flat-panel antennae is designed to be mounted on one of the four sides of the rooftop tower 310 and is designed for direct mounting to the elevator housing of a building. In the depicted example, the panels are also included on the sides of the rooftop tower 310 that are not shown to obtain a 360° field of view. It is also possible to position the panel antennae and other locations near the top of a building, ideally disposed through 360° of field of view around the building. The arrays are equipped with phase shifting circuits and equalizing networks, as discussed below, with +/−90 degrees of vertical and horizontal steering for the beam center on each of the flat panels, to provide 360° coverage for communications. Nearby locations can utilize groundwave transmission while distant locations can utilize the skywave capability of the array.

To create an efficient design at frequencies below about 25 MHz, each flat panel antenna 315, 320 is approximately 18 feet×18 feet×6 inches thick and is composed of four elements (as shown, for example in FIGS. 6 and 7 that are fed individually by a phase shifting circuit. Transmit, receive and control equipment (not shown) can be contained within the elevator housing or some weather protected structure adjacent to the antennae in EMP-shielded cabinets, for example, using standard 19-inch rack mounted equipment. The flat panel antenna arrays e.g., 315, 320 can be center fed from coaxial cables using a feed through in each wall of the building tower (e.g., elevator tower or water tower). Sets of phase shifters (also not shown in FIG. 3) can be positioned behind each antenna panel and the transmit, receive and control devices.

We now consider the underlying basis for applying fractal geometry to the design of antennae for the frequency range of about 10 KHz to 30 MHz. As an example, in this preferred embodiment, the basic mathematical equation of the specific fractal we want to use, in this case the Koch Snowflake, is defined. The Koch Snowflake 104 is derived from the Koch curve 400 as described below:

The Koch Snowflake can be constructed by starting with an equilateral triangle 101, then recursively altering each line segment as follows:

1. Divide the line segment into three segments of equal length.

2. Draw an equilateral triangle 102 that has the middle segment from step 1 as its base and points outward.
3. Remove the line segment that is the base of the triangle from step 2.

Then determine the perimeter of the Koch Snowflake

Figure 1:
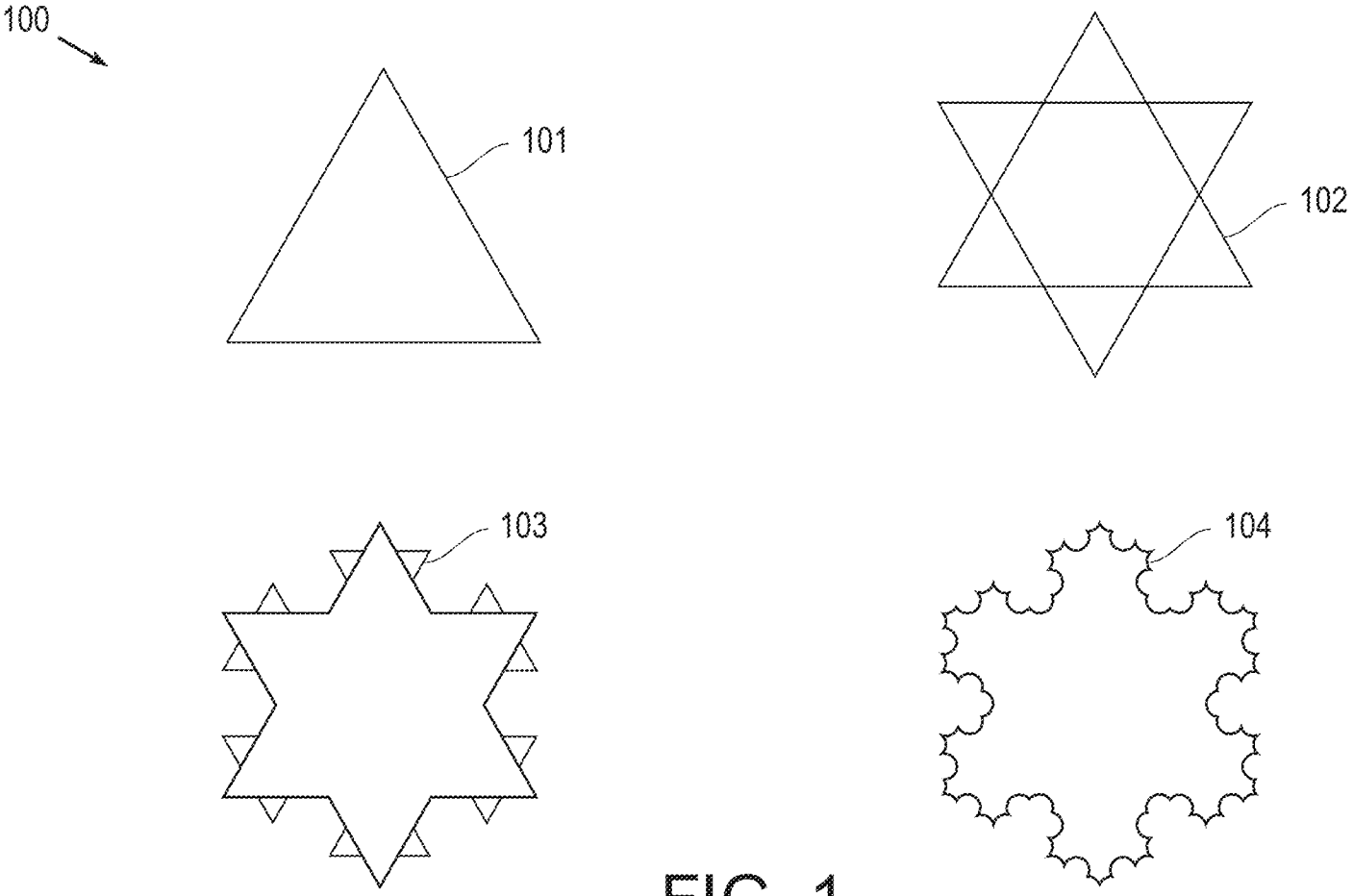
FIG. 1 (PRIOR ART)
FIG. 1 shows four iterations of the Koch Snowflake fractal according to the prior art.

Each successive iteration 103, 104 multiplies the number of sides in the Koch Snowflake by four (FIG. 1), so the number of sides after n iterations is given by:

$$N_n = N_{n-1} \cdot = 3 \cdot 4^n \tag{1}$$

If the original equilateral triangle has sides of length s, the length of each side of the snowflake after n iterations is:

$$S_n = \frac{S_{n-1}}{3} = \frac{s}{3^n} \tag{2}$$

which is an inverse power of three multiple of the original length. The perimeter of the snowflake after n iterations is:

$$P_n = N_n \cdot S_n = 3 \cdot s \cdot \left(\frac{4}{3}\right)^n \tag{3}$$

Mathematically speaking, the Koch curve has an infinite length, because the total length of the curve increases by a factor of ⅔ with each iteration. Each iteration creates four times as many line segments as in the previous iteration, with the length of each one being ⅓ the length of the segments in the previous stage. Hence, the length of the curve after n iterations will be $(4/3)^n$ times the original triangle perimeter and is unbounded, as n tends to infinity.

From the above discussion, we can see how the perimeter of a Koch curve can be derived. When taken in light of the previous discussion of effective length of an Antenna, it is now clear how a long antenna can be constructed in a small area. The number of iterations of the curve determines the ultimate effective length and thus the frequency range of the antenna.

In practice, the maximum number of iterations that can be constructed is determined by the spatial resolution of the machinery used in the fabrication. This spatial resolution in turn constrains the length of any given line segment formed by the machinery. Modern CNC (Computer Numerical Control) manufacturing equipment is easily capable of making line segments as short as 0.001 inch. However, folding a plurality of such short segments would not result in a useful increase in effectiveness. However, once we consider segment lengths on the order of 0.005 inches or greater, the folded structures of the Koch Curve start to add up to a considerable perimeter length which equates to a longer effective length of the antenna element.

Referring again to FIG. 1 of the Koch Snowflake as an example of how the iteration of a structure is used to construct a complex fractal, the first iteration 101 is a simple equilateral triangle. The second iteration 102, takes the form of a six-pointed star. When iterated again ($3^{rd}$ iteration) 103 each point of the star gets the multi-pointed structure superposed on it. In each successive iteration 104, this operation is performed, ultimately to infinity unless limits are set.

Figure 4:
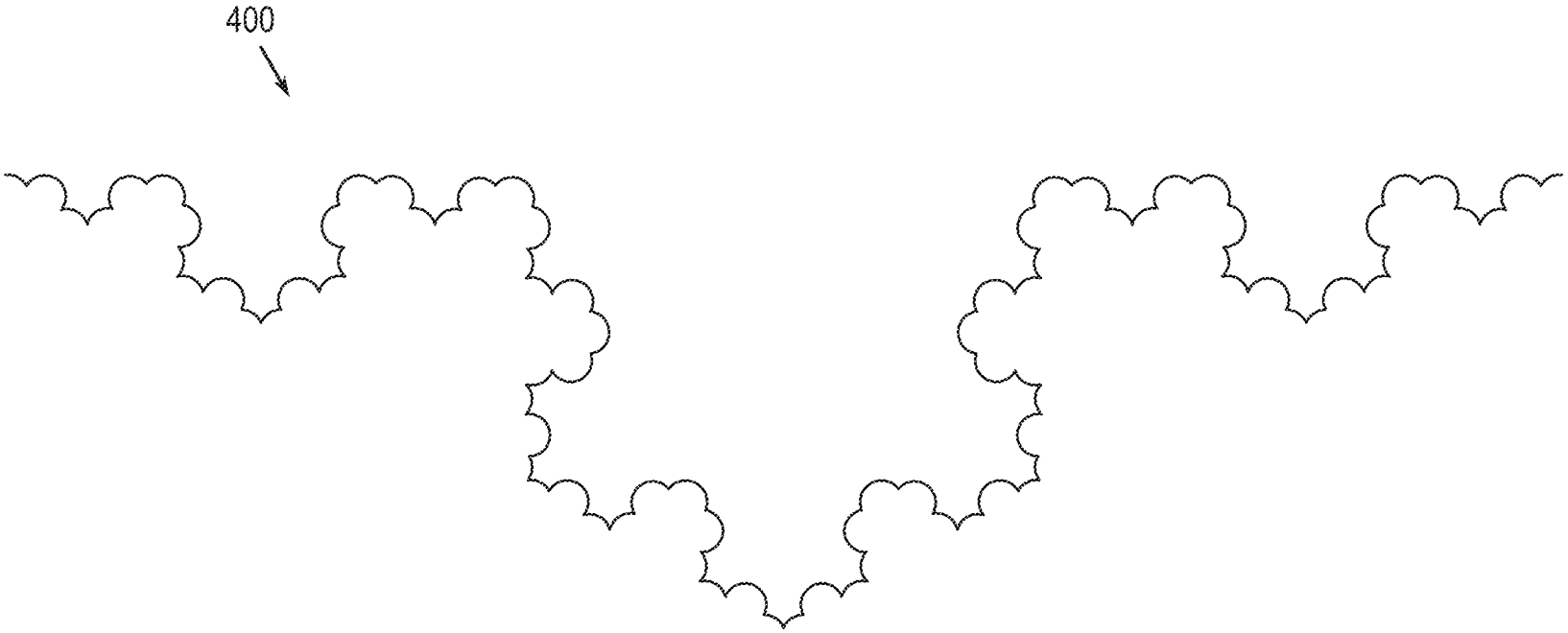
FIG. 4 shows a section of a Koch Curve after multiple iterations.

FIG. 4 shows a zoomed view of a curve segment 400 of the $n^{th}$ iteration of the Koch curve and is representative of the line lengthening (perimeter/effective length) characteristic of an antenna according to the present disclosure. The Koch Snowflake and curve can be used as the basis of the fractal geometry for the antenna according to the present disclosure. For example, in one three-dimension embodiment, described below with reference to FIG. 14, a variation of a spiral antenna 1400 has its effective length increased by application of the Koch Snowflake fractal whose vector rotates and increments around the long axis 1402 of the shape.

Figure 5:
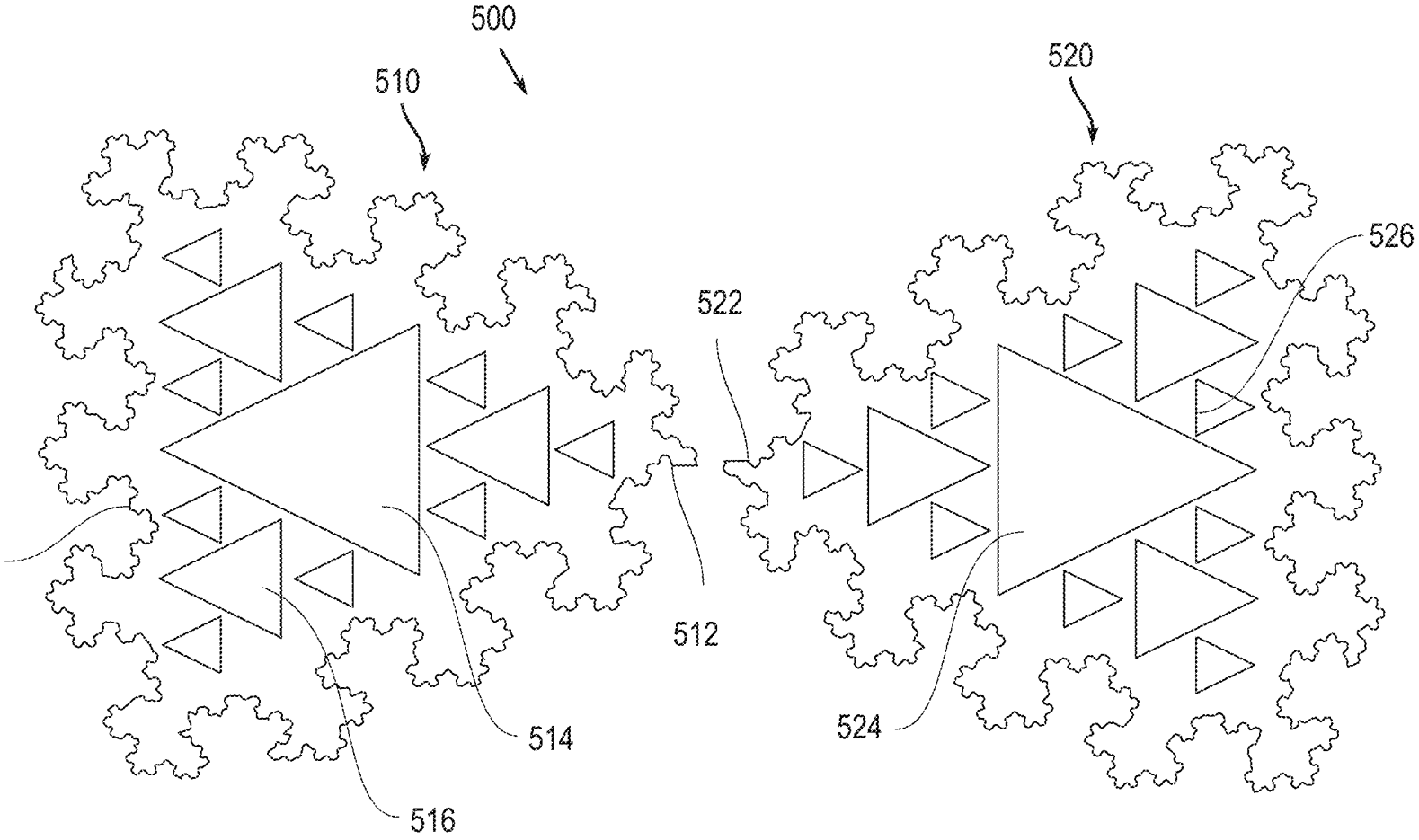
FIG. 5 shows a bowtie fractal antenna according to an embodiment of the present disclosure.

A further enhancement can be obtained by the superposition of two or more fractal geometries to form a single, complex geometry. Distinct embodiments of such superposed antenna geometries are shown in FIGS. 5 and 7. FIG. 5 depicts a bow-tie fractal antenna array 500 having two large elements 510, 520. The center points of each bowtie are the feed points 512, 522. In FIG. 5, the pattern includes what is known as a Sherpinski Blanket, which incorporates a repeating triangle fractal pattern similar to what is shown in 514, 516, 524. FIG. 7 depicts a similar design in which two Koch bow-tie patterns having Sherpinski Blanket patterns superposed arranged at 90° angles to each other. These designs exemplify a means of extending the effective length even further than can be achieved by use of a single fractal. This technique can also be used to provide multi-band performance by providing a second resonance band due to the additional internal perimeter dimension which can resonate either additively with the first perimeter or independently.

Figure 6:
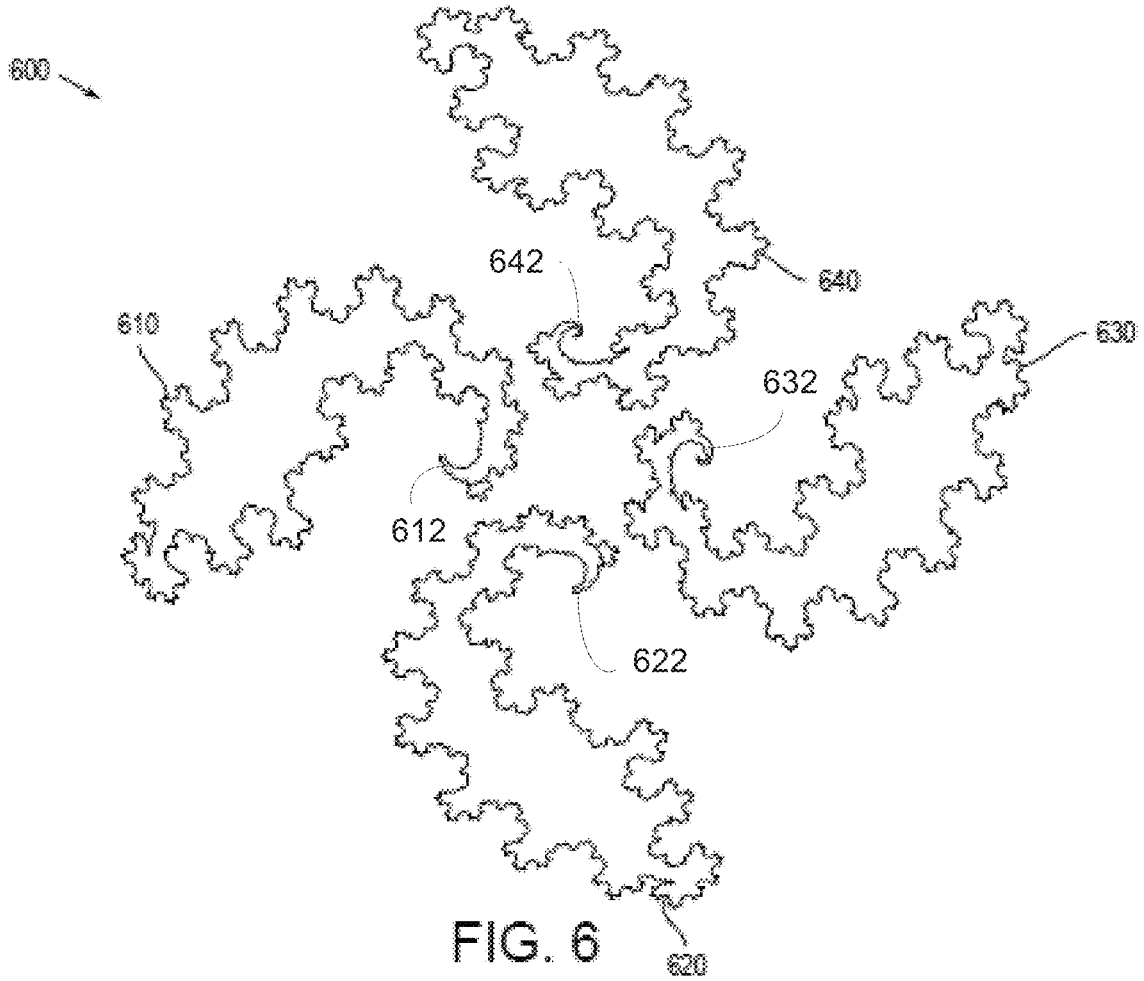
FIG. 6 shows a 4-element 2 axis spiral fractal array antenna design according to another embodiment of the present disclosure.
Figure 7:
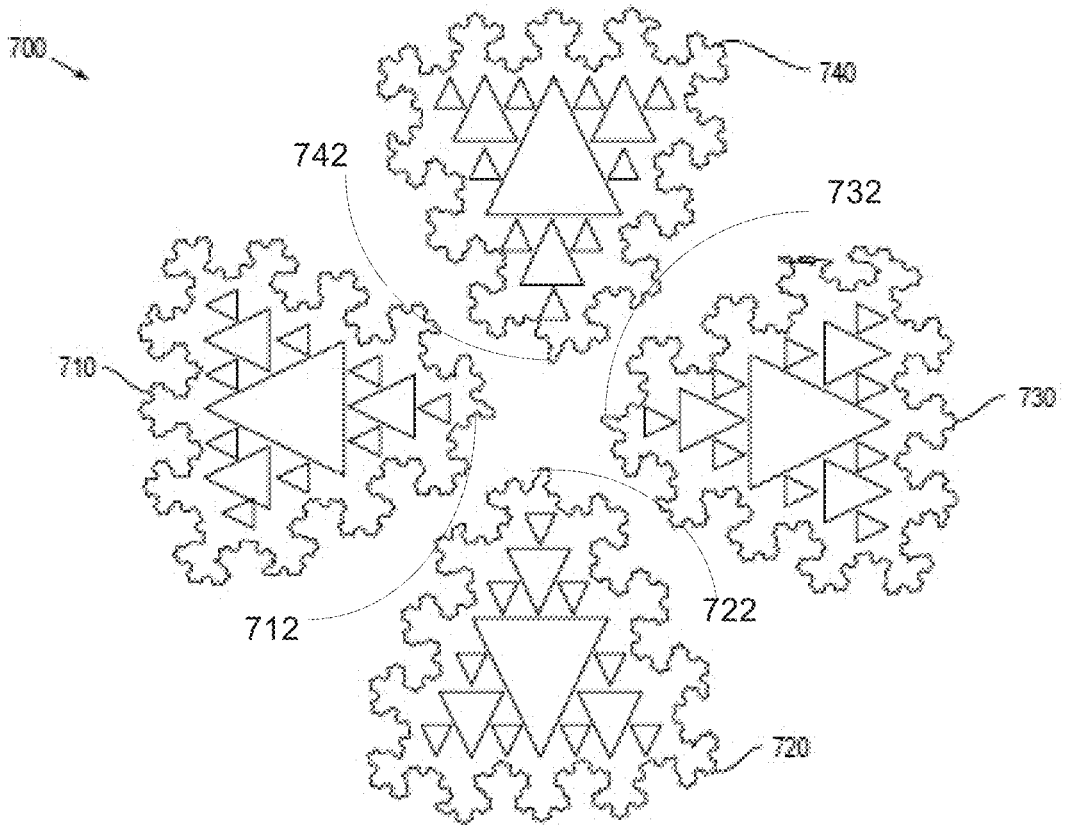
FIG. 7 shows a 4-element 2 axis bowtie fractal array antenna design according to another embodiment of the present disclosure.

FIGS. 6 and 7 depict fractal antenna embodiments according to the present disclosure which each have four elements. FIG. 6 is an antenna 600 with a quad-spiral pattern having four spiral fractal elements 610, 620, 630, 640 that extend outwardly from a central point. The antenna elements have respective signal feed points 612, 622, 632, 644. The elements 610-640 are mutually spaced approximately 90° apart. FIG. 7 is an antenna 700 with a dual bow-tie pattern including four bow-tie elements 710, 720, 730, 740 with respective feedpoints 712, 722, 732, 742. Each element 710-740 has the Sherpinski Blanket pattern superposed upon it. The elements 710-740 are mutually spaced approximately 90° apart in this embodiment. In both 600 and 700, each element (610-640; 710-740) is electrically isolated from the others, and the center points are the isolated feedpoints for the RF input from the phase shifters 900. It is noted that in these designs, it is possible to have more than four elements (or less)

Figure 8:
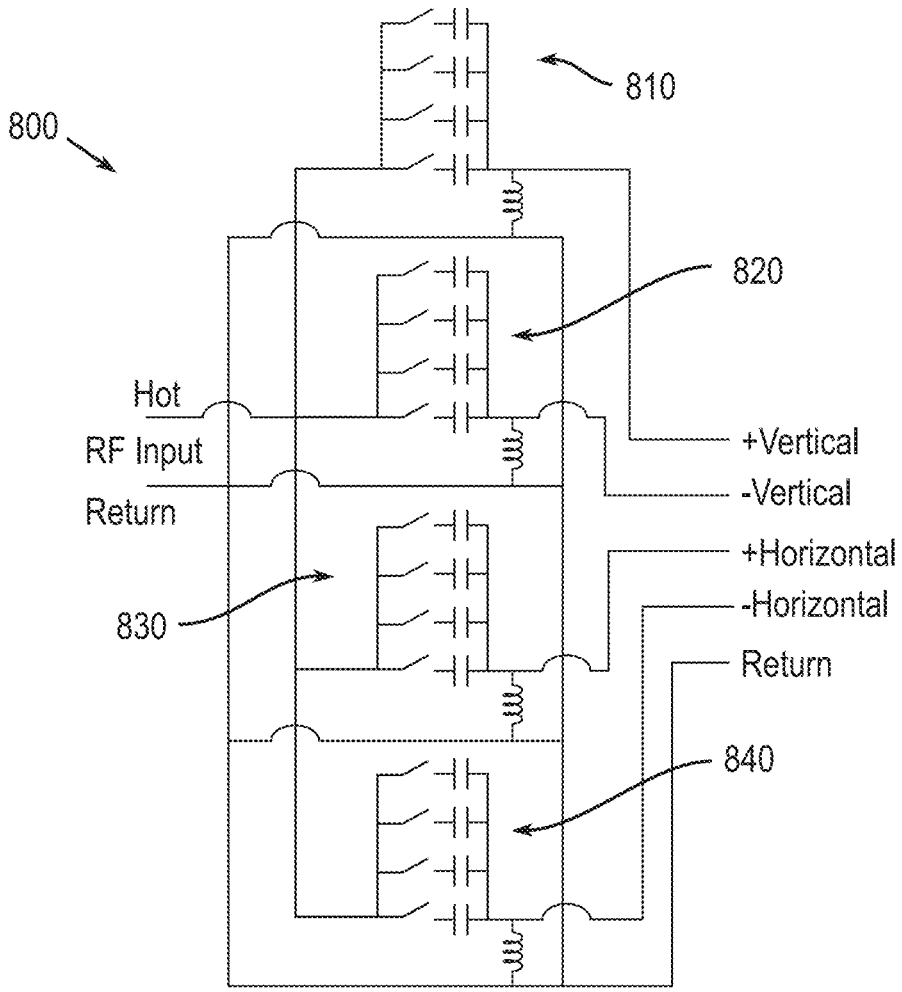
FIG. 8 shows a schematic an exemplary phase shifting feed circuit that can be used with fractal antenna arrays according to the present disclosure. A circuit for a 4 element array is shown.
Figure 9:
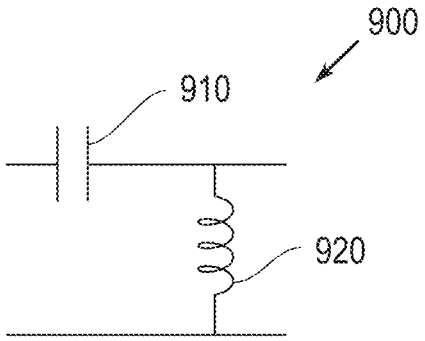
FIG. 9 shows a sub-element-of the basic phase shifting feed circuit according to an embodiment of the present disclosure.

The feedpoints of each antenna element of the embodiments of FIGS. 2A, 5, 6 and 7 are coupled to a phase shift circuit 900 which is preferably positioned behind the antenna arrays in a sheltered location. A schematic diagram of an exemplary phase shift circuit 800 is shown in FIG. 8. Before describing the phase shift circuit of FIG. 8, reference is made to FIG. 9 which shows a basic high pass filter component 900 of the phase circuit. In FIG. 9, an input signal 905 is fed to capacitor 910. The capacitor is in series with an inductor to form a high pass filter. It is possible to substitute resistor for the inductor in this circuit. The output is taken across the inductor. The values of the capacitor 910 and inductor (or resistor) are selected to produce a desired phase shift angle. By modifying the values of the phase shifting components, other phase shift angles can be achieved.

Referring again to FIG. 8, a phase shift circuit adapted for four fractal antenna panels according to the present disclosure is shown. The circuit 800 includes four banks 810, 820, 830, 840 each arranged with a series switchable capacitor bank and an inductor (or resistor) in shunt which allow for a plurality of phase shift angles to be achieved. Each capacitor bank corresponds to the component 900 shown in FIG. 9, with differing capacitor values (and associated phase shifts) based on the switching configuration. The phase shift circuit shown in FIG. 8 can be used for four fractal antenna panels mounted as shown in the building arrangement shown in FIG. 3. There is a phase shifter circuit 800 for each antenna panel. For example, if 360° coverage is required, four phase shifter circuits and four antennae panels are employed. In the embodiment shown in FIG. 8, each capacitor bank includes 4 switches. As there are four capacitor banks there are 16 switches in total, which corresponds to a 16-bit format. A control computer (not shown) is provided as the host for the system. The computer generates the necessary control signals to drive the phase shifters and routes the RF power accordingly. The phase shift circuits as described herein can be conveniently addressed by a single 64-bit word from a host computer.

Figure 10:
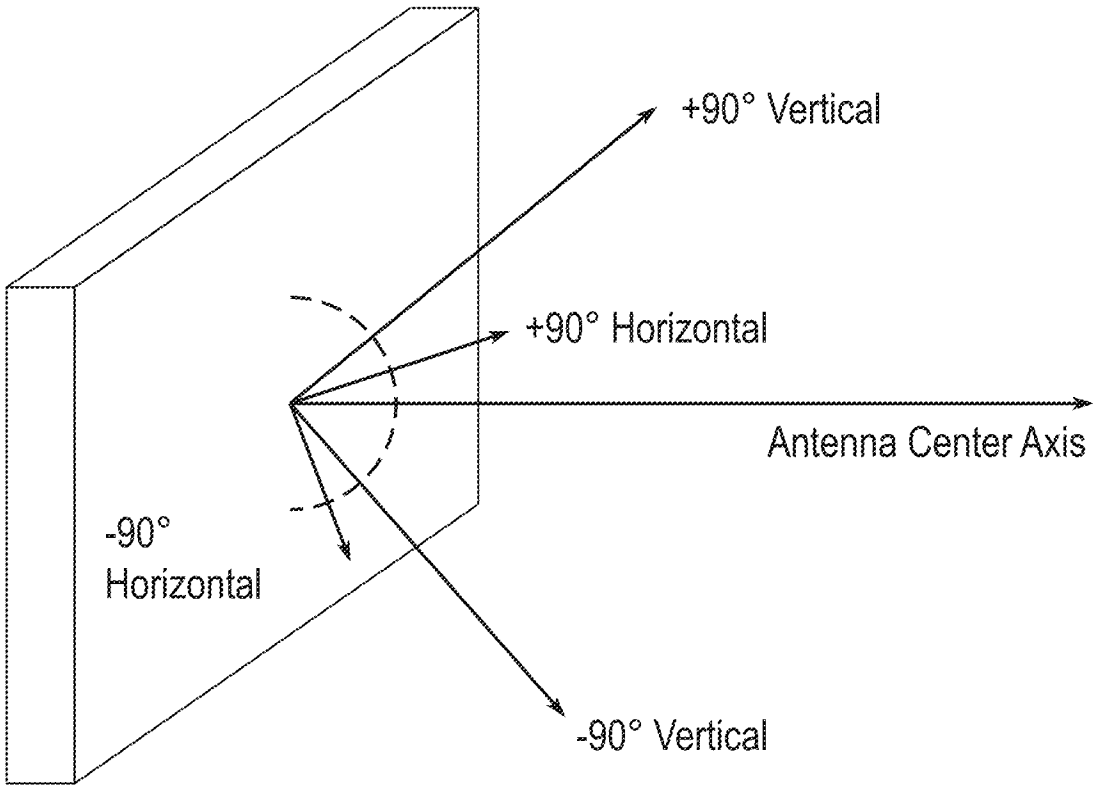
FIG. 10 is a schematic diagram depicting the beam steering that can be achieved using the fractal antenna arrays according to the present disclosure.

Switching is incorporated into the phase shift network to provide a plurality of phase shift angles, which, when combined in the RF output of the antenna, cause the beam to steer in one direction or another. The 16-bit switching phase shifter circuit shown in FIG. 8 is similar to circuits used in radar systems. The circuit can effectively steer the array through $2\pi$ steradians (a hemisphere). This configuration creates 16 different phase angles between 0° and 168.75° in steps of 11.25° in both the horizontal and vertical planes. A schematic diagram that depicts beam steering that can be achieved using fractal antenna arrays according to the present disclosure is shown in FIG. 10. It is again noted that each panel of a complete 360° array has its own 16-bit phase shifter, and all four phase shifters can be operated independently to enable creation of multiple simultaneous beam paths. The four resulting hemispherical antennae patterns allow the system to be steered through a full 360° in azimuth and 90° in elevation. If finer resolution is required, a phase shift circuit with greater range can be used or more antennae panels and additional phase shifters. At the frequencies of interest in the embodiments described herein, 11.25° steps are adequate, but any step angle can be used given appropriate circuitry to support it. There should be some mention in the spec that the antennae will work in both pulse and continuous modes The same circuit elements are used in transmitting as well as receiving. Routing is performed by a transmit/receive switch located before the phase shifter and after both the transmitter and the receiver.

Figure 11:
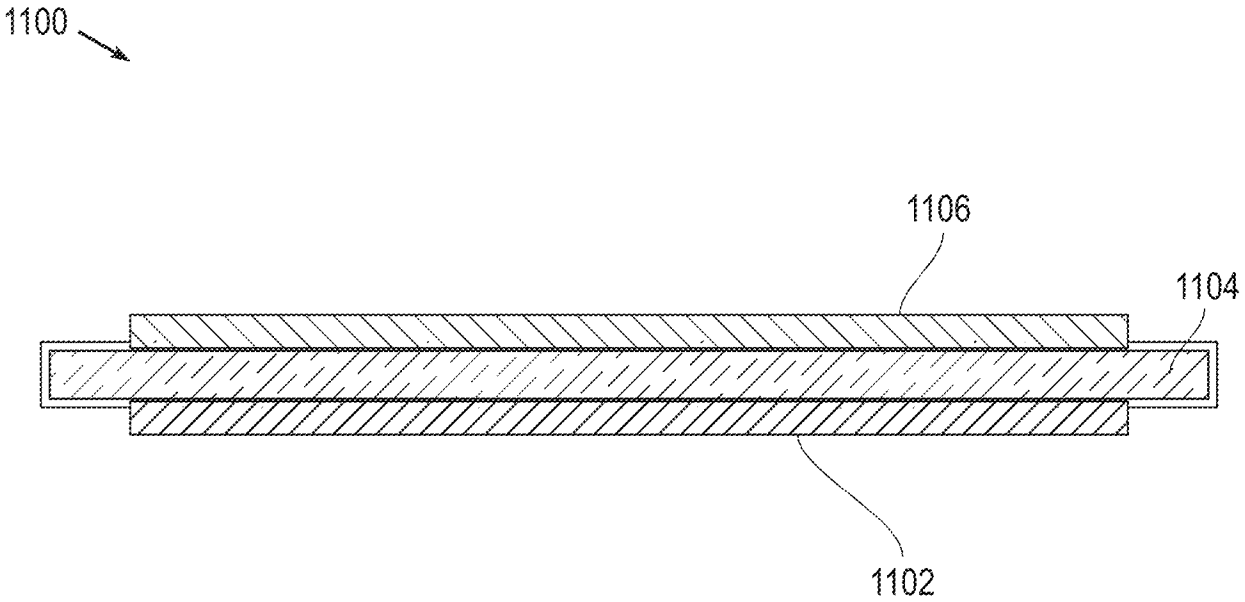
FIG. 11 is a schematic cross-sectional view of an antenna, substrate and ground plane.

Inside a typical antenna array support enclosure, there are cabinets which house transmitters and receivers providing typically 1 kW or more radio frequency output centered at a specific frequency. In certain Implementations, the output can be centered at 4 MHz with up to a +/−1.5 MHz bandwidth to address the entire 3 MHz to 5 MHz band. The receivers and control electronics can receive path propagation information from WWV in Ft. Collins Colorado, and from WWVH in Hawaii, or other propagation beacon systems, to provide real-time compensation of transmitted power to account for changes in propagation on a given path. To further enhance the efficiency of the array, a ground plane is provided that covers, but is electrically isolated from, the entire rear surface of the antenna. A schematic diagram of an embodiment of a ground plane 1100 that can be employed in the embodiment described herein is shown in FIG. 11. The ground plane includes a substrate 1102 and an insulator 1104 to which an antenna 1106 is mounted. The amount of insulation required (i.e., the thickness and/or material of the insulator 1104) is a function of the maximum RF voltage applied to the antenna. The insulator 1104 is sized to withstand at least twice the maximum RF voltage applied to the antenna in transmit mode. In receive mode the voltages on the antenna are small and do not tax the insulator if constructed as described above.

If operation at multiple frequencies is desired, two or more antenna arrays of smaller size can be stacked in a single package. In this configuration, allowances for offsetting the feedlines are made. A full second set of phase shifters, tuned to the frequency passband of the second array is then provided. Additional transmitters and receivers may also be required for the frequency band of interest. Additional phase shifters can be used if more than two arrays are stacked, one set per array. Multiple frequencies can also be supported in a single antenna element by superposing a second fractal pattern over the first. This is shown in FIGS. 5 & 7, where a Sherpinski "Blanket (Triangle pattern) is placed within the perimeter of a Koch Snowflake, Careful selection of the dimensions and angular structure of the triangles yields control over the effective length and thus the resonant frequency of this sub-element.

There are several practical methods of manufacture available to physically produce these two-dimensional arrays. These include but are not limited to CNC water jet, CNC laser cutter, CNC plasma cutter, large bed CNC milling machine, CNC router. It is theoretically possible to cut the array elements by hand but achieving the degree of precision necessary would be an onerous task.

Figure 21:
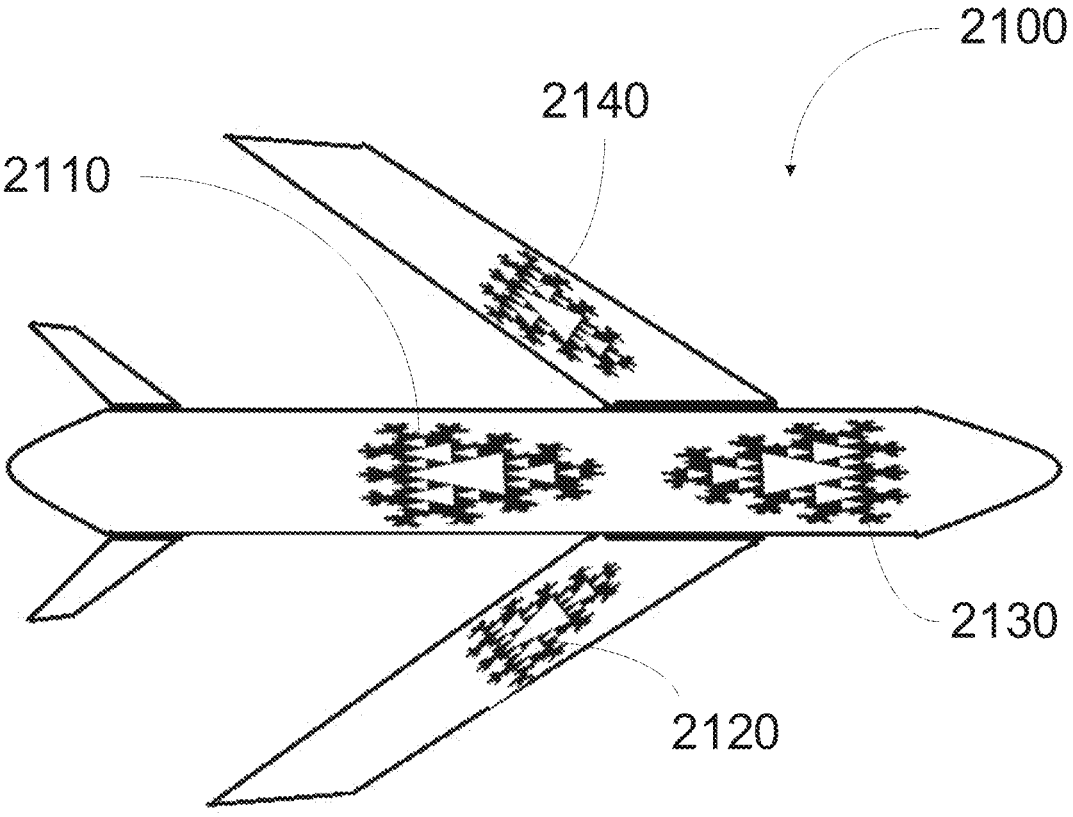
FIG. 21 shows an exemplary aircraft in which fractal antenna arrays according to the present disclosure are installed.

The fractal, near-fractal and super-fractal antennae disclosed herein can be used in numerous applications and circumstances. While FIG. 3 illustrates an important example of employing panels of fractal antennae on a building tower to provide 360° radiation coverage, FIG. 21 illustrates the placement of fractal antennae on an aircraft 2100. In the example depicted, four Koch fractal bow-tie elements 2110, 2120, 2130 are 2140 are positioned on the underside of the aircraft 2100 which provides a downward-facing pattern that is swept electronically. Spiral or other fractal patterns can also be used in the antennae.

The use of fractal antennae (including near-fractal and super-fractal antennae) for low-frequency applications is distinct from the use of fractal geometry for high-frequency applications is several ways. The first distinction is that the fractal antennae disclosed herein are built at a scale that is orders of magnitude larger than systems used for higher frequencies. This demands, among other things, totally different methods of manufacture. The demand for compact low frequency has existed since radio was invented. The need for covert antennae systems is equally as old, particularly for military and intelligence applications. To date, no one appears to have recognized or taken steps to address this need.

Another distinction is that the antennae topologies of the present invention have not, to date, been used at lower frequencies. It is difficult to get a usable effective length with conventional antenna geometries. Accordingly, virtually all HF (high frequency; frequencies below about 30 MHz) and lower frequencies take the form of some sort of long wire or beam structure. The addition of the fractal structures significantly increases the effective length to a point where antenna designs traditionally used in the microwave band can be realized in the lower frequencies.

The use of superposed fractal structures is yet another distinction. This is not found in microwave class fractal antennae, yet is an important tool in the design of HF and LF fractal class antennae due to the lengthening of the perimeter and thus the effective length that it allows.

Three-Dimensional Fractal Antenna Embodiments

The use of the fractal antennae of the present disclosure enables configurations to be realized that have never been previously achieved. For example, FIG. 2B shows the predicted antenna pattern of the antenna of FIG. 2A of the present disclosure when operated in the VLF portion of the spectrum as determined by use of 3-Dimensional Electromagnetic modeling. Historically, antennae in this portion of the band have been omnidirectional (having essentially uniform radiation in all directions). FIG. 2B shows a clear directional pattern. This directionality is sufficient to eliminate potential fratricidal effects on the sender when transmitting at high power levels.

One can consider long wire antennae and beam antennae to be one-dimensional structures. They have length but essentially no width. While a long wire antenna is one dimensional, fractal antennae are of necessity two-dimensional. Thus, the present invention is distinguished over prior art antenna by virtue of being two-dimensional rather than one dimensional. This distinction extends even to antenna such as the Rhombic design which is typically a large long wire that is supported by four insulated supports and takes the shape of a diamond. The horizontally-disposed diamond shape of the Rhombic is open at one end and one side gets the source conductor and the other gets the return conductor from the transmitter and antenna tuner (if present). This structure is still a long wire even though it has been folded.

Therefore, in contrast to the one-dimensionality of existing HF and LF antennae, any practical realization of a fractal antenna has to be at least two-dimensional. The fractal design can also be extended to three dimensions. It is well known that fractals can be represented in three dimensions. The discussed below, with reference to FIGS. 12-20, describes embodiments of fractal antennae with a three-dimensional geometry.

When describing a prior art long wire or beam antenna as one dimensional, it is meant that there is one significant dimension, the length of the element, and that the width is merely that which is sufficient for mechanical stability and integrity. Thus, a long wire is only as thick as the diameter of the wire. For practical purposes this dimension is ignored the long wire (or beam) is considered to be one-dimensional. Similarly, the embodiments of the fractal antennae shown in FIGS. 2A, 4, 5, 6 and 7 are considered to be two-dimensional structures, with the thickness sufficient to meet the mechanical support requirements.

In contrast, three-dimensional fractal antennae have three dimensions in which all dimensions of these dimensions are tangible and have real dimensions beyond those needed for mechanical support. The three-dimensional form gives the designer an additional degree of freedom in design. Additional effective length can now be easily achieved by taking advantage of the substantially larger surface area now available.

Figure 12:
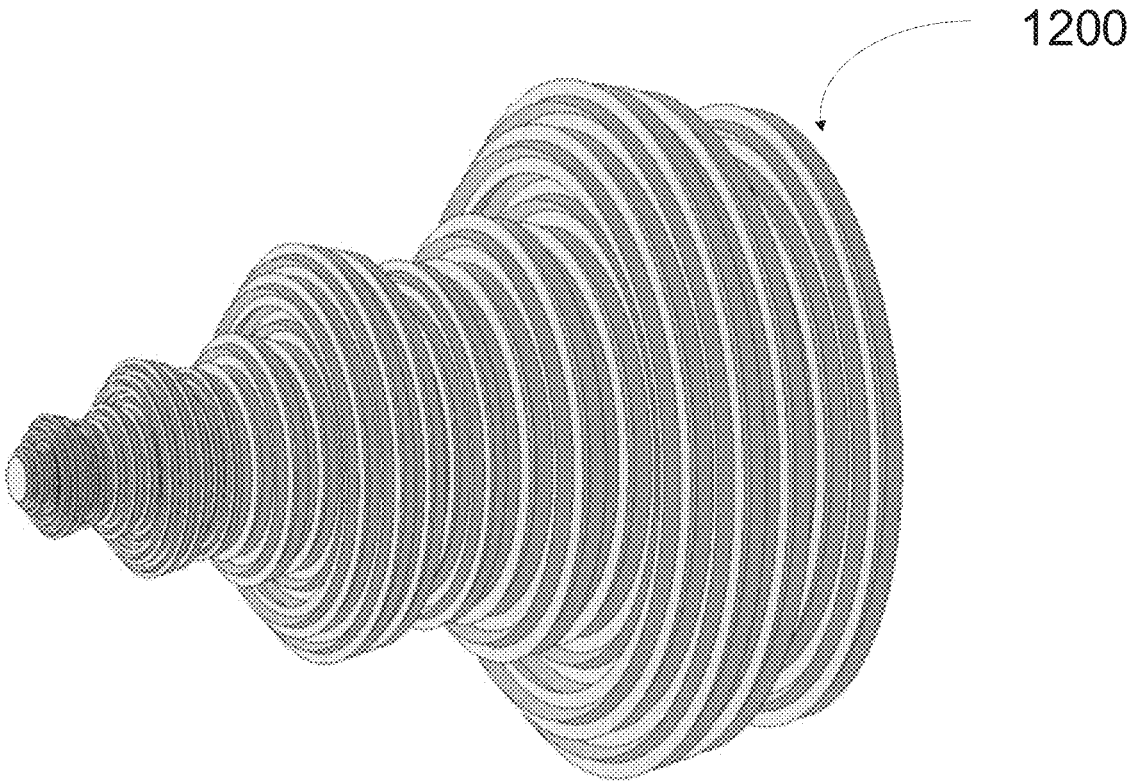
FIG. 12 is a perspective view of a three-dimensional fractal antenna according to an embodiment of the present disclosure.

An example of this concept would be an antenna whose basic shape is a cone. One could apply a Koch Curve to the surface starting at the apex of the cone and proceeding to the base and achieve a substantially longer effective length than one would get if a merely straight-line was used. FIG. 12 is a perspective view of a three-dimensional fractal antenna 1200 according to an embodiment of the present disclosure having a generally cone-like shape. The surface of the antenna has a Koch Curve profile as is shown in FIG. 4 which is rotated through some angle, in this case 360°, to obtain a three-dimensional object with a convoluted surface and significantly greater surface area than a smooth cone. This antenna element has a substantially increased effective length.

Figure 18:
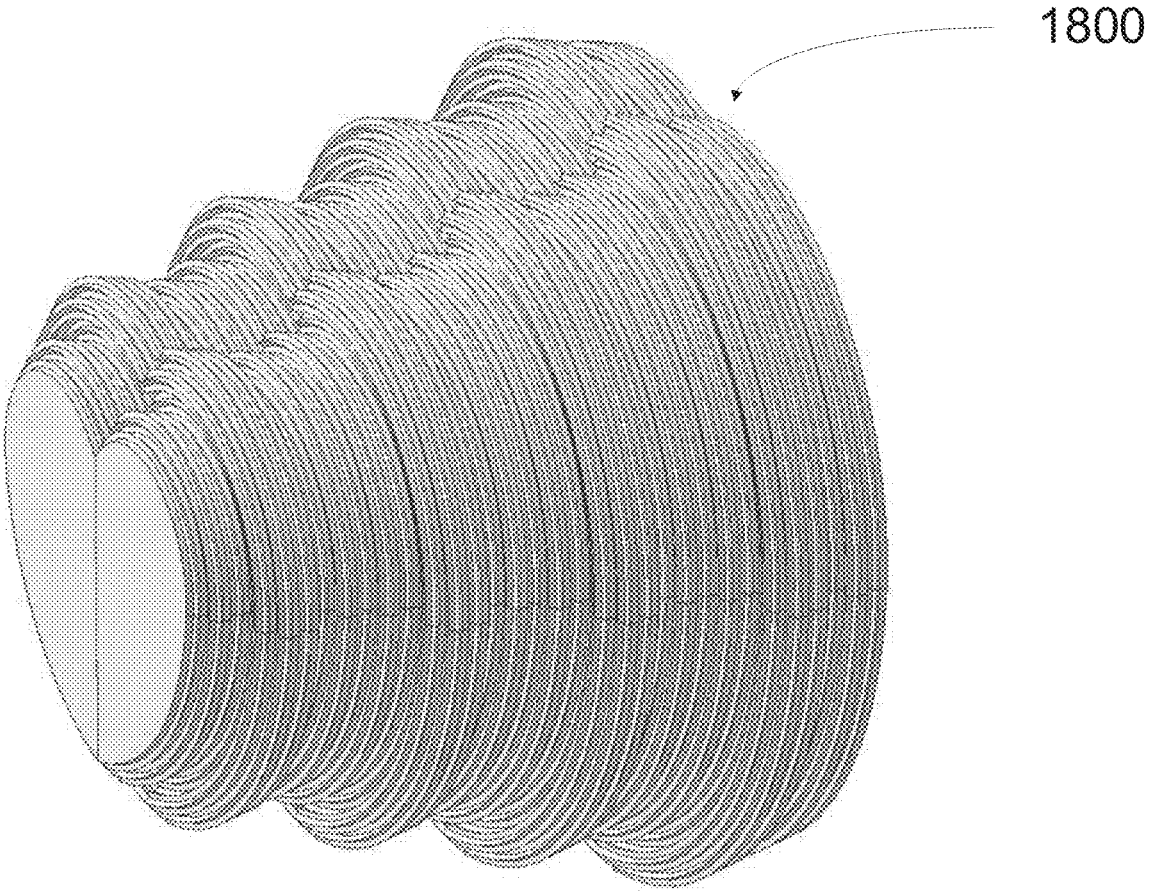
FIG. 18 is a perspective view of an asymmetrical three-dimensional fractal antenna based on a cardioid (heart) shape according to an embodiment of the present disclosure.

More generally, antennae with a three-dimensional fractal form have several advantages over a two-dimensional fractal antenna. Due to the increase in effective surface area, it is possible to perform beamforming with just the physical structure by the intentional selective introduction of asymmetries. Selective introduction of asymmetries into the structure creates the necessary electric field configurations to produce the equivalent of an active phased array without need for the electrical circuit. This is shown in FIG. 18 where the fractal is created on a cardioid shaped structure.

The three-dimensional fractal antennae shown here are fed via a coaxial line that is routed to the narrow end of the structure and connected at the apex, as has been shown previously in the two-dimensional configurations of FIGS. 2A, 4, 5, 6, and 7. It is noted that other feed configurations are possible.

It is not necessary to have all the emitting surfaces on the outer surface of the 3-D Fractal. It is known that certain cold cathode electron field emission structures can emit electrons from areas below the apparent surface. An example of such a cathode is found in U.S. Pat. No. 4,950,962 by the present inventor. If the fractal surface is appropriately shaped and has features akin to porosity, it can still emit RF even if the point of emission is not on the exterior surface of the antenna element.

If the three-dimensional fractal antenna is symmetrical, its radiated field is either generally toroidal around the long axis of the structure or a $2\pi$ steradian field (a hemisphere) that has its large dimension on the ground. If the three-dimensional structure is asymmetrical, then the resulting field will mirror the asymmetry as shown, for example, in the design of FIG. 18.

There are numerous possible geometries that a three-dimensional antenna can take. This affords the designer a wide degree of latitude. The interplay between the underlying algorithm and the geometric shape it is superposed on provides orders of magnitude more control of the complexity of the resulting electric field. The design and analysis of this class of antennae is made possible by the use of three-dimensional electromagnetic modeling software. There are several excellent packages that are capable of this level of analysis. For example, the data presented in the two-dimensional embodiment of FIG. 2B was calculated with Integrated Engineering Software's 3D Electromagnetic modeling package using the Boundary Element Method.

In this disclosure of the present invention, we introduce the concepts of "near-fractal" and "super-fractal" antennae. The distinction between these two geometries and a true fractal geometry lies in the way the pattern repeats. In a true fractal there is a repetition that is some fractional relationship from one iteration to the next, with the relationship be constant to said fraction. In a near-fractal antenna, the repetition is constant and linear from one iteration to the next. We also introduce the concept of the super-fractal antenna geometry. Here the repetition varies non-linearly from one iteration to the next. This introduces significant complexity to the design. In this form, the only possible way to design such a super-fractal antenna is with the use of a computer and appropriate 3D electromagnetic modeling software as previously described.

Figure 13:
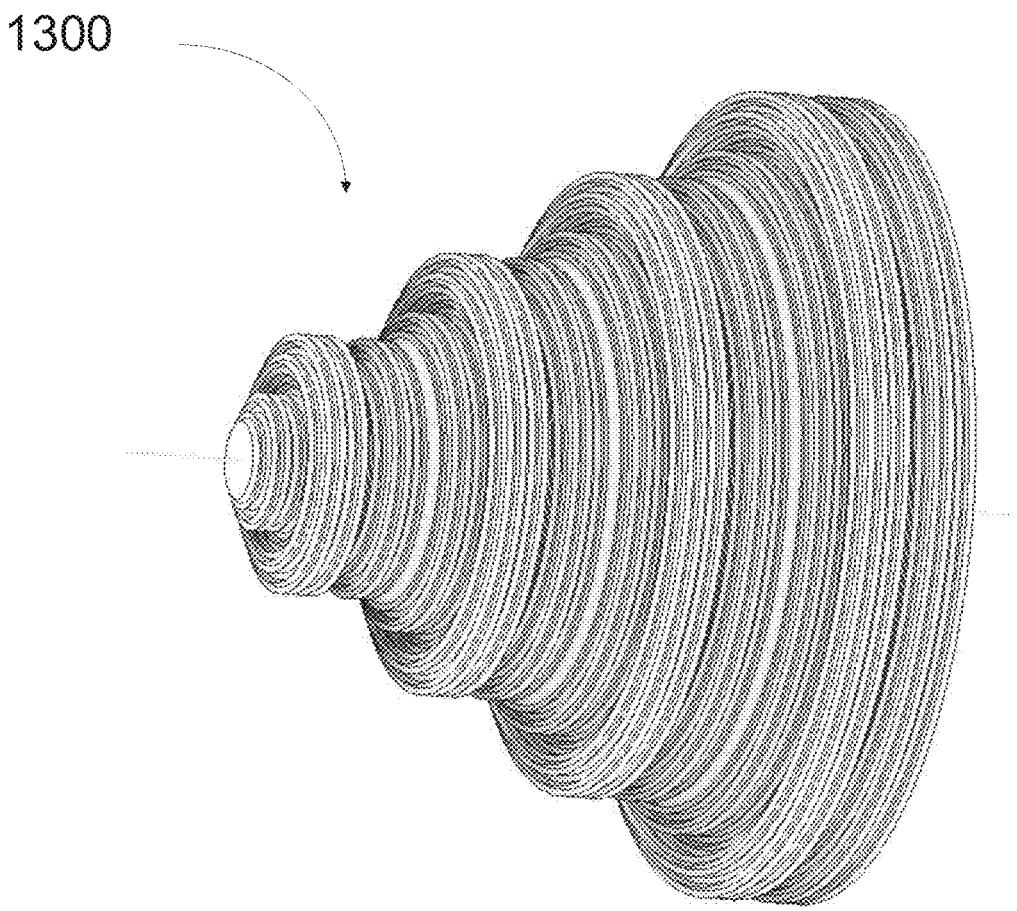
FIG. 13 is a perspective view of a three-dimensional "near-fractal" antenna according to an embodiment of the present disclosure.

FIG. 13 is a perspective view of a near-fractal antenna 1300 according to an embodiment of the present disclosure. This design differs from the true fractal antenna in that while along the radials of the surface, the topology is a fractal curve, the spacing between repetitions is held constant rather than decreasing by some factor (⅔ in the case of the example shown in FIG. 12 which is based on the classic Koch Curve and Snowflake). This approach produces a longer perimeter value resulting in a longer effective length.

Figure 14:
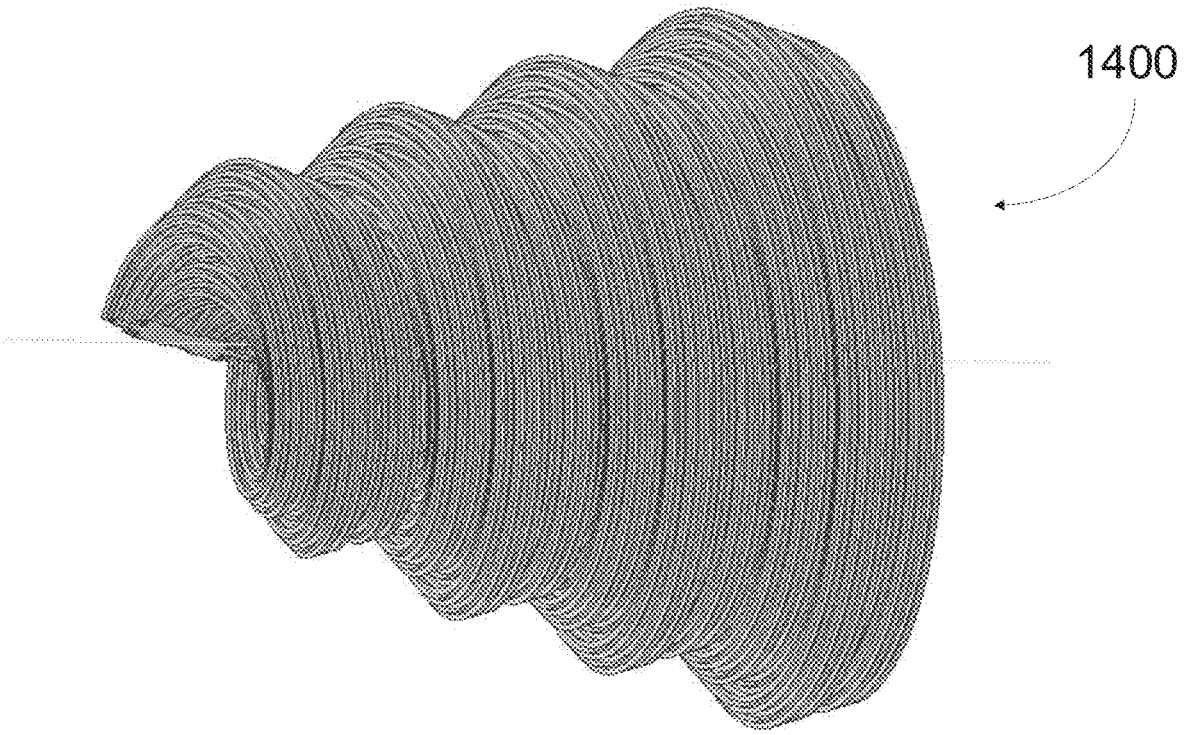
FIG. 14 is a perspective view of a spiral three-dimensional fractal antenna according to an embodiment of the present disclosure.
Figure 15:
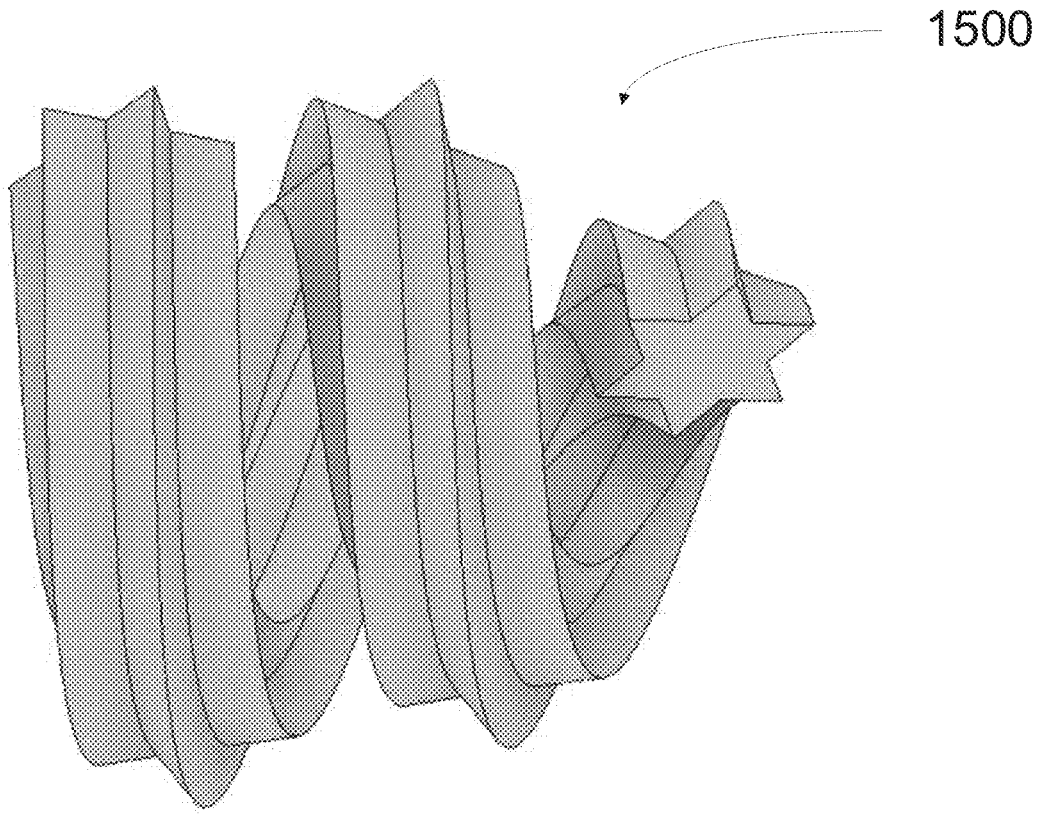
FIG. 15 is a perspective view of a spiral three-dimensional "near-fractal" antenna according to an embodiment of the present disclosure.

In the designs of FIGS. 12 and 13, the fractal curve is rotated through 360° resulting in a pattern of parallel bands of the fractal curve. FIG. 14 shows an example of a three-dimensional antenna in which the fractal curve is extended in a spiral rather than a circular pattern. As is the case with the design of FIG. 12, it is possible to generate a "near-fractal" design of this embodiment as well, as shown in FIG. 15. The design complexity can be increased by using an asymmetrical shape as the underlying shape of the antenna.

Figure 16:
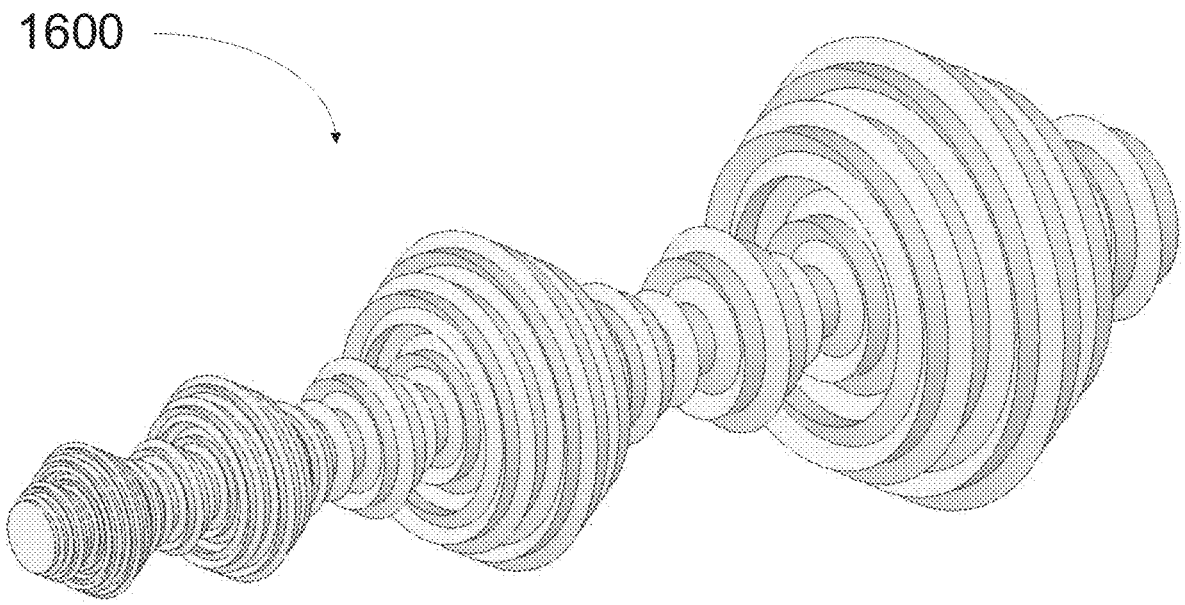
FIG. 16 depicts a cylindrical three-dimensional fractal antenna according to an embodiment of the present disclosure.
Figure 17:
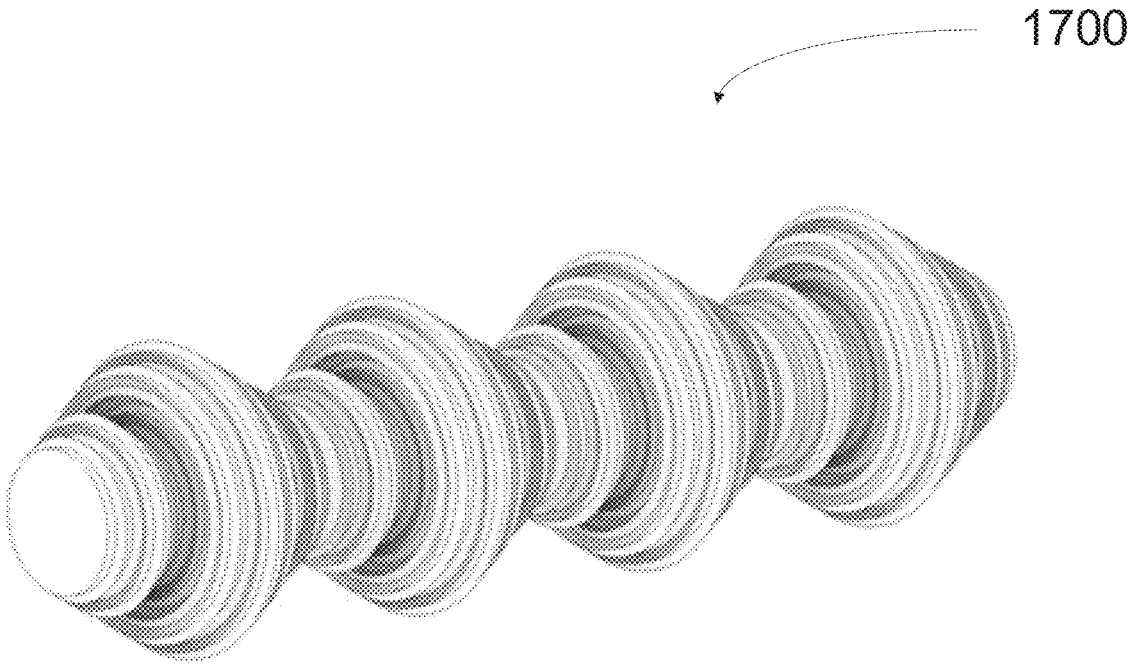
FIG. 17 depicts a cylindrical three-dimensional "near-fractal" antenna according to an embodiment of the present disclosure.
Figure 19:
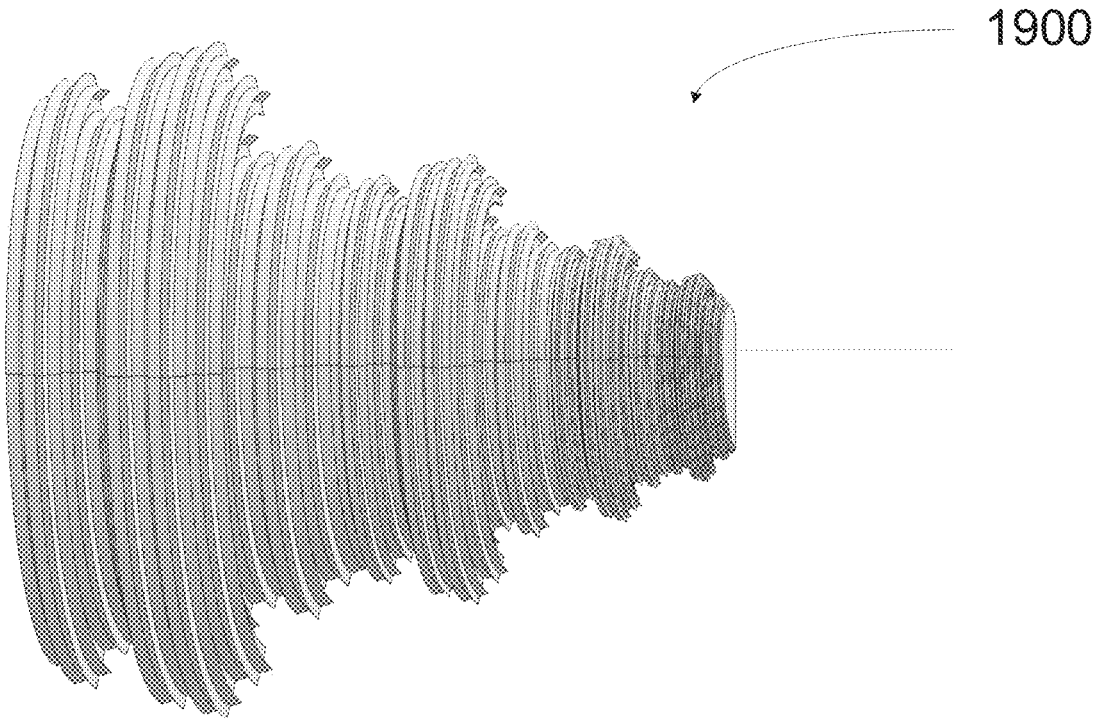
FIG. 19 is a perspective view of an asymmetrical three-dimensional near-fractal antenna based on a cardioid (heart) shape according to an embodiment of the present disclosure.

It is noted that the underlying geometric structures to the entire class of three-dimensional fractal, "near-fractal", and super-fractal antennae are not limited to conical structures. Another alternate structure is a cylinder. FIGS. 16 and 17 show cylindrical three-dimensional fractal and near-fractal antennae, respectively. Other shapes are possible. FIG. 18 shows an asymmetrical (along one axis) cardio-shaped fractal antenna. FIG. 19 shows an asymmetrical cardio-shaped near-fractal antenna.

It is noted that the novel class of three-dimensional fractal, near-fractal, and super-fractal antennae have broad application across the electromagnetic spectrum. While the two-dimensional fractal antennae are seen here as being useful for compact and covert (when necessary) devices for HF and LF applications, the three-dimensional variants have applicability over a much broader spectrum.

It is further noted that while the manufacture of the two-dimensional variants are easily manufactured by conventional CNC means, the three-dimensional variants are uniquely well-suited to be manufactured by three-dimensional additive manufacturing means, also known as stereolithography and commonly known as 3D printing.

Figure 20:
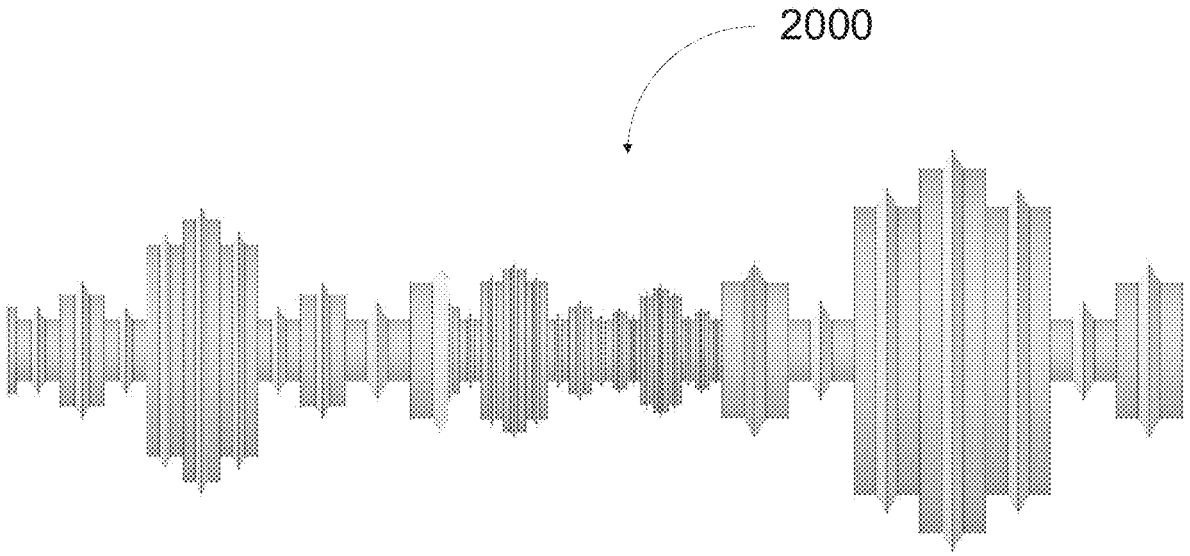
FIG. 20 shows an archetypal super-fractal cylindrical antenna, representative of the whole class.

FIG. 20 shows an example of a super-fractal antenna according to ane embodiment of the present disclosure. Depicted is a cylindrical variant antenna 2000 shown in side view so that the non-linearity of the fractal pattern repetition is visible. The non-linearity has been exaggerated in this figure to make the non-linearity more apparent.

It is noted that multiple three-dimensional fractal, near-fractal, and super-fractal can be used in various combinations which, when driven using phase shift networks as previously described can achieve complex beam patterns and multiple beam configurations. Additionally, various, fractal, near-fractal and super-fractal patterns can be superposed together in various combinations.

In addition to the increase in effective length, another advantage the three-dimensional fractal antennae disclosed herein has is that in their asymmetrical forms, they produce directional field patterns. Unlike the two-dimensional designs described above, if beam steering is not needed for a given application, only directionality, the three-dimensional fractal class of antennae does not require external phase shifting circuitry. The beamforming is achieved by controlled interference of portions of the radiated field, which are created by selective deviations from the symmetrical case (which produces a uniform toroidal or $2\pi$ steradians field). However, it is noted that three-dimensional fractal antennae systems can include phase-shifting circuitry depending on the desired beam-forming characteristics of particular designs and systems.

There are a number of important applications for the fractal, near-fractal and super-fractal antennae disclosed herein in the very low frequency (VLF) range. It is well known that VLF radiation penetrates through the earth with relatively little attenuation. This property in combination with the extreme reduction in size provided by the antennae disclosed herein presents opportunities for numerous military applications.

Fractal (including near-fractal and super-fractal) antennae have unique defensive and offensive capabilities heretofore unavailable due to the size of prior art components. The use of 2- and 3-dimensional fractal antennae enables VLF systems that are small enough to be mounted on military vehicles, vessels, and other craft and used in a theater of operations.

Let us consider the antenna shown in FIG. 2A and its radiation pattern (FIG. 2B). This antenna can be made in a size commensurate with the width of modern military vehicles, typically a maximum of 5 meters in order to be able to travel on roads. A practical example of this type of installation would be on a vehicle similar to an armored personnel carrier. In circumstances in which operation is stationary, e.g., in which a vehicle is driven to a location and the system set up to operate once there, then antennae of about 7 meters to around 10 meters in width can be employed. The antenna elements can be folded flat on the roof of the vehicle and erected once at the desired operating site, and in this configuration, a beam pattern can be advantageously formed and oriented in front of the vehicle. This minimizes the amount of RF emission that the crew, vehicle, and associated friendly forces are subjected to.

Alternately, smaller antennae can be used, on the order of 5 meters or less in width, which allows the antenna to be left permanently mounted in its operating position, and thus usable while the vehicle is in motion.

There are three major categories of application for the fractal antennae systems for military/defense: intelligence applications, defensive applications and offensive applications.

Intelligence: Fractal antennae systems can be configured to search for and locate underground structures of any type. Such systems can be configured to listen for emissions in this portion of the spectrum for other sources in operation at the pertinent location. These sources can be either friendly or opposition sources. If friendly, the system can operate as a covert radio communications system. If opposition sources are present, the system can be used to detect and locate said sources.

Defensive: Fractal antennae systems can be used to transmit signals that, if properly crafted, are capable of causing explosives to explode, be they ordnance or improvised explosive devices (IED's). This is done by inducing electrical currents in the bridgewire portions of the detonators and within the explosives themselves. The induced current is sufficient to cause either Ohmic heating or induce an electric current in the bridgewire of the detonator which leads to the explosion of the device. Fractal antenna system having sufficient power can also be used against aerial threats, generally along the same principles.

Offensive: Fractal antenna systems can used to direct radiation toward underground structures such as bunkers, manufactories, etc. to cause induction of large currents in power and control wiring and within electronic devices. Such induced currents can disable or destroy these components. Aboveground, the system can be aimed at ground-level or aerial targets with similar effect.

Two-dimensional or three-dimensional fractal antenna systems for such military applications can comprise a vehicular or other mobile or fixed platform with sufficient load capacity and size to accommodate the equipment required and space for operators. The equipment includes the fractal antenna elements, transmit and receive electronics, power supply, fuel. If the antenna elements are two-dimensional, such equipment further includes shifting electronics. When three-dimensional antennae are employed, phase shifting electronics are optional depending on the target application.

It is to be understood that any structural and functional details disclosed herein are not to be interpreted as limiting the systems and methods, but rather are provided as a representative embodiment or arrangement for teaching one skilled in the art one or more ways to implement the methods.

It is to be further understood that like numerals in the drawings represent like elements through the several figures, and that not all components or steps described and illustrated with reference to the figures are required for all embodiments or arrangements.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the either of the terms "comprises" or "comprising", when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to a viewer. Accordingly, no limitations are implied or to be inferred.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A fractal antenna comprising:

a plurality of antenna elements each having a two-dimensional or three-dimensional fractal shape;

an electrical transmitter and receiver circuit coupled to the plurality of antenna elements operative to provide electrical power to and maintain phase relationships between the plurality of antenna elements; and a phase-shifting circuit coupled to each of the plurality of antenna elements which is operative to modify a phase of the input signal on all antenna elements;

wherein the electrical transmitter and receiver circuit provides a signal to the plurality of antenna elements that causes the plurality of antenna elements to radiate in low-frequency (LF) bands, and wherein the phase-shifting circuit is operable to form and steer a beam of LF radiation in a specific direction toward a targeted receiver located at a distance not reachable by radiation outside of the LF frequency range.

2. The fractal antenna of claim 1, wherein the antenna includes two elements, each having a spiral shape.

3. The fractal antenna of claim 1, wherein the antenna includes two elements, which together form a Koch bow-tie shape.

4. The fractal antenna of claim 1, wherein at least one additional fractal pattern is superposed onto the two-dimensional fractal shape of the plurality of fractal antennas.

5. The fractal antenna of claim 4, wherein the antenna includes two elements, which together form a Koch bow-tie shape, and each of the elements has a Sherpinski Blanket pattern superposed on the Koch bow-tie shape.

6. The fractal antenna of claim 1, wherein the phase shifting circuit is operative to steer the beam of LF radiation from the plurality of elements through $2\pi$ steradians.

7. The fractal antenna of claim 1, wherein at least one of the plurality of antenna elements is a three-dimensional fractal, near-fractal, or super-fractal antenna having a fractal, near-fractal or super-fractal shape.

8. The antenna of claim 7, wherein the three-dimensional antenna has a cone-shaped basic shape and a fractal geometric profile.

9. The antenna of claim 7, wherein the three-dimensional antenna has a cone shape and a near-fractal geometric profile.

10. The antenna of claim 7, wherein the three-dimensional antenna has a cone-shaped basic shape and a super-fractal geometric profile.

11. The antenna of claim 7, wherein the three-dimensional antenna has a spiral shape and a fractal geometric profile.

12. The antenna of claim 7, wherein the three-dimensional antenna has a spiral shape and a near-fractal geometric profile.

13. The antenna of claim 7, wherein the three-dimensional antenna has a spiral shape and a super-fractal geometric profile.

14. The antenna of claim 7, wherein the three-dimensional antenna has a cylindrical shape and a fractal geometric profile.

15. The antenna of claim 7, wherein the three-dimensional antenna has a cylindrical shape and a near-fractal geometric profile.

16. The antenna of claim 7, wherein the three-dimensional antenna has a cylindrical shape and a super-fractal geometric profile.

17. The antenna of claim 7, wherein the three-dimensional antenna has an asymmetrical shape in at least one dimension.

18. The antenna of claim 7, wherein the antenna is modified by introduction of asymmetries to perform beamforming.

19. A system for detecting an underground structure:

a mountable platform upon which one or more fractal, near-fractal or super-fractal antenna elements are installed;

an electrical transmitter and receiver circuit coupled to the one or more antenna elements operative to provide electrical power and control the one or more antenna elements; and phase shifting circuitry coupled to the one or more antenna elements operative to control a phase shift between the one or more antenna elements;

wherein the one or more antenna elements are configured to detect LF signals emitted from the underground structure, and wherein the phase-shifting circuitry is operable to form and steer a beam of LF radiation in a specific direction toward a targeted receiver located at a distance not reachable by radiation outside of the LF frequency range.

20. The system of claim 19, wherein at least one of the antenna elements is a three-dimensional fractal, near-fractal or super-fractal antenna element.

21. The system of claim 19, wherein at least one of the antenna elements is a two-dimensional fractal, near-fractal or super-fractal antenna element.

22. The system of claim 19, wherein the one or more antenna elements are foldable so as to fit onto the platform.

23. A system for activating an explosive device remotely for defensive purposes comprising:

a platform upon which one or more fractal, near-fractal or super-fractal antenna elements are installed;

an electrical transmitter and receiver circuit coupled to the one or more antenna elements operative to provide electrical power and control the one or more antenna elements; and phase shifting circuitry coupled to the one or more antenna elements operative to control a phase shift between the one or more antenna elements;

wherein the transmitter and receiver circuit is configured to cause the one or more antenna elements to radiate in a directed beam in an LF band toward the explosive device, the beam of radiation operative to induce currents in the explosive device that causes Ohmic heating or induces an electrical current to activate a detonator circuit which leads to an explosion of the device, and wherein the phase-shifting circuitry is operable to form and steer a beam of LF radiation in a specific direction toward the explosive device located at a distance not reachable by radiation outside of the LF frequency range.

24. The system of claim 23, wherein at least one of the antenna elements is a three-dimensional fractal, near-fractal or super-fractal antenna element.

25. The system of claim 23, wherein at least one of the antenna elements is a two-dimensional fractal, near-fractal or super-fractal antenna element.

26. The system of claim 23, wherein the one or more antenna elements are foldable so as to fit onto the platform.

27. A fractal antenna weapon system comprising:

a vehicle having a mounted platform upon which one or more fractal, near-fractal or super-fractal antenna elements are installed;

an electrical transmitter and receiver circuit coupled to the one or more antenna elements operative to provide electrical power and control the one or more antenna elements; and phase shifting circuitry coupled to the one or more antenna elements operative to control a phase shift between the one or more antenna elements;

wherein the transmitter and receiver circuit is configured to cause the one or more antenna elements to radiate in a directed beam in the LF band toward a structure not reachable by radiation outside of the LF frequency range having one or more electrical or electronic components, the beam of radiation operative to induce currents in the one or more electrical or electronic components to disable or destroy the one or more components, and wherein the phase-shifting circuitry is operable to form and steer a beam of LF radiation in a specific direction toward the structure located at a distance not reachable by radiation outside of the LF frequency range.

28. The system of claim 27, wherein at least one of the antenna elements is a three-dimensional fractal, near-fractal or super-fractal antenna element.

29. The system of claim 27, wherein at least one of the antenna elements is a two-dimensional fractal, near-fractal or super-fractal antenna element.

30. The system of claim 27, wherein the one or more antenna elements are foldable so as to fit onto the platform of the vehicle.

31. An aircraft comprising:

an underside surface;

one or more antenna elements having a two-dimensional fractal shape positioned on the underside surface;

an electrical transmitter and receiver circuit coupled to the one or more antenna elements operative to provide electrical power to the one or more antenna elements; and phase shifting circuitry coupled to the one or more antenna elements operative to control a phase shift between the one or more antenna elements;

wherein the electrical transmitter and receiver circuit provides a signal to the one or more antenna elements that causes the one or more antenna elements to radiate in low-frequency (LF) bands, and wherein the phase-shifting circuit is operable to form and steer a beam of LF radiation in a specific direction toward a receiver located at a distance not reachable by radiation outside of the LF frequency range.

* * * * *